US009567182B2

(12) United States Patent
Takada

(10) Patent No.: US 9,567,182 B2
(45) Date of Patent: Feb. 14, 2017

(54) MEDIUM HANDOVER DEVICE AND MEDIUM PROCESSING DEVICE

(71) Applicant: Oki Electric Industry Co., Ltd., Tokyo (JP)

(72) Inventor: Atsushi Takada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/648,897

(22) PCT Filed: Nov. 8, 2013

(86) PCT No.: PCT/JP2013/080318
§ 371 (c)(1),
(2) Date: Jun. 1, 2015

(87) PCT Pub. No.: WO2014/087803
PCT Pub. Date: Jun. 12, 2014

(65) Prior Publication Data

US 2015/0314977 A1 Nov. 5, 2015

(30) Foreign Application Priority Data

Dec. 5, 2012 (JP) ..... 2012-266260

(51) Int. Cl.
*B65H 31/06* (2006.01)
*G07D 11/00* (2006.01)
(Continued)

(52) U.S. Cl.
CPC ..... *B65H 31/24* (2013.01); *B65H 29/22* (2013.01); *B65H 29/58* (2013.01); *B65H 31/06* (2013.01);
(Continued)

(58) Field of Classification Search
CPC .. G07D 11/0018; G07F 19/203; G07F 19/202; B65H 31/06; B65H 1/025; B65H 2701/1912
See application file for complete search history.

(56) References Cited

FOREIGN PATENT DOCUMENTS

DE WO 0163566 A1 * 8/2001 ..... G07D 11/0018
DE WO 2011015545 A1 * 2/2011 ..... G07D 11/0018
(Continued)

*Primary Examiner* — Luis A Gonzalez
(74) *Attorney, Agent, or Firm* — Rabin & Berdo, P.C.

(57) ABSTRACT

A medium handover device is provided including: a fixed peripheral side section that covers portions of side faces enclosing a periphery of a collection space in which a paper sheet shaped medium is collected, other than at least a portion of an opposing side face opposing a medium support section supporting the medium inside the collection space, which portion is open, and other than at least a portion of an adjacent side face adjacent to the opposing side face, which portion is open; a lid section that has a shape covering portions of the side faces enclosing the periphery of the collection space that are not covered by the fixed peripheral side section; a transition section that transitions the lid section to enable the lid section to adopt a closed state with respect to the fixed peripheral side section in which the lid section is close to or abutting the fixed peripheral side section and the collection space is closed, and to adopt an open state with respect to the fixed peripheral side section in which at least a portion of the lid section is separated from the fixed peripheral side section and the collection space is opened; and a transfer section that transfers the medium between an interior and an exterior of the collection space.

14 Claims, 24 Drawing Sheets

(51) Int. Cl.

| | |
|---|---|
| ***B65H 31/24*** | (2006.01) |
| ***B65H 29/22*** | (2006.01) |
| ***B65H 29/58*** | (2006.01) |
| ***G07F 19/00*** | (2006.01) |
| ***B65H 31/10*** | (2006.01) |

(52) U.S. Cl.

CPC ..... *B65H 31/10* (2013.01); *G07D 11/0018* (2013.01); *G07F 19/201* (2013.01); *G07F 19/202* (2013.01); *B65H 2402/31* (2013.01); *B65H 2402/32* (2013.01); *B65H 2402/441* (2013.01); *B65H 2402/45* (2013.01); *B65H 2402/50* (2013.01); *B65H 2402/64* (2013.01); *B65H 2404/1413* (2013.01); *B65H 2407/11* (2013.01); *B65H 2408/13* (2013.01); *B65H 2511/20* (2013.01); *B65H 2511/417* (2013.01); *B65H 2601/521* (2013.01); *B65H 2701/1912* (2013.01)

(56) References Cited

FOREIGN PATENT DOCUMENTS

| | | | |
|---|---|---|---|
| JP | S59-48825 | U | 3/1984 |
| JP | S60-164268 | U | 10/1985 |
| JP | H05-58474 | A | 3/1993 |
| JP | H0633254 | U | 4/1994 |
| JP | H07210725 | A | 8/1995 |
| JP | 2006-209274 | A | 8/2006 |
| JP | 2009-140420 | A | 6/2009 |
| JP | 2009-140420 | A | 6/2009 |

* cited by examiner

MEDIUM HANDOVER DEVICE AND MEDIUM PROCESSING DEVICE

TECHNICAL FIELD

This application claims priority from Japanese Patent Application No. 2012-266260, filed Dec. 5, 2012, the disclosure of which is incorporated in its entirety by reference herein.

The present invention relates to a medium handover device and a medium processing device that can be applied to, for example, a banknote processing device (known as a teller machine) installed at a service counter of a financial institution.

BACKGROUND ART

Conventionally, banknote processing devices are commonly used to perform various transaction processing such as cash deposits or withdrawals for a customer, operated by an operator who is a service counter representative (known as a teller) at a service counter of a financial institution (see, for example, Japanese Patent Application Laid-Open (JP-A) No. 2009-140420, FIG. 1).

Such banknote processing devices are provided with banknote handover sections in pay-in sections into which the operator inserts banknotes, and pay-out sections from which the operator removes banknotes, namely, in sections that exchange banknotes with the operator.

For example, as illustrated in FIG. 19A and FIG. 19B, in a conventional banknote handover section 610, a space for holding banknotes BL (referred to below as a collection space SC) is formed inside a rectangular block shaped frame 621. The banknotes BL are held overlapped in an upright state in the collection space SC, namely with their sheet faces facing each other, and with their short direction running from top to bottom.

The banknote handover section 610 is provided with an openable and closable shutter 622 at a portion, for example at an upper side, of the collection space SC from the perspectives of reducing noise and securing safety.

When banknotes BL are paid out in the banknote handover section 610, the banknotes BL to be paid out are conveyed one note at a time from inside the device, discharged into the collection space SC by a discharge section 28, and thereby sequentially stacked, in a closed state of the shutter 622. The shutter 622 is then opened, enabling the operator to remove the banknotes BL from the collection space SC.

SUMMARY OF INVENTION

Technical Problem

As schematically illustrated in the plan view of FIG. 20, the banknote processing device 601 is, for example, installed at a service counter of a financial institution so as to be adjacent to the left and right of respective operators OP who face customers CS across a counter CT.

The banknote processing device 601 has a height similar, for example, to that of the midriffs of the operators OP when seated on chairs, and the banknote handover section 610 serving as a pay-out section is provided to an upper face, or to a portion spanning from the upper face to a side face.

Accordingly, when the shutter 622 opens, the seated operators view the banknotes BL inside the collection space SC of the banknote handover section 610 of the banknote processing device 601 looking down from the diagonal top left and right, rather than from directly above.

As illustrated in FIG. 19A and FIG. 19B, the shutter 622 only opens and closes an upper face of the banknote handover section 610, and the sides of the collection space SC are enclosed by peripheral side portions, even when the shutter 622 is open.

Accordingly, in the banknote handover section 610, even when the shutter 622 is in the open state, a portion of the collection space SC is concealed by the peripheral side portions, preventing the banknotes BL inside the collection space SC from being adequately visible as seen from the vantage point of the operators OP.

When multiple types of banknotes BL of different sizes are handled in the banknote processing device 601, it is necessary to set the height of the collection space SC of the banknote handover section 610 large enough to hold the type of banknote BL that has the longest length along the short direction.

As a result, in particular when holding banknotes BL that have a short length in the short direction in the collection space SC, the banknotes BL in the banknote handover section 610 are largely concealed by the peripheral side portions, and the banknotes BL are barely visible.

The banknotes BL held in the collection space SC of the banknote handover section 610 are therefore not sufficiently visible even when the shutter 622 is in the open state, resulting in an accompanying detriment to the ease of operation when removing the banknotes BL.

In consideration of the above circumstances, the present invention proposes a medium handover device and a medium processing device enabling improved visibility of a medium exchanged with an operator.

Solution to Problem

A medium handover device of a first aspect of the present invention includes: a fixed peripheral side section that covers portions of side faces enclosing a periphery of a collection space in which a paper sheet shaped medium is collected, other than at least a portion of an opposing side face opposing a medium support section supporting the medium inside the collection space, which portion is open, and other than at least a portion of an adjacent side face adjacent to the opposing side face, which portion is open; a lid section that has a shape covering portions of the side faces enclosing the periphery of the collection space that are not covered by the fixed peripheral side section; a transition section that transitions the lid section to enable the lid section to adopt a closed state with respect to the fixed peripheral side section in which the lid section is close to or abutting the fixed peripheral side section and the collection space is closed, and to adopt an open state with respect to the fixed peripheral side section in which at least a portion of the lid section is separated from the fixed peripheral side section and the collection space is opened; and a transfer section that transfers the medium between an interior and an exterior of the collection space.

A medium processing device of another aspect of the present invention includes: a fixed peripheral side section that covers portions of side faces enclosing a periphery of a collection space in which a paper sheet shaped medium is collected, other than at least a portion of an opposing side face opposing a medium support section supporting the medium inside the collection space, which portion is open, and other than at least a portion of an adjacent side face adjacent to the opposing side face, which portion is open; a lid section that has a shape covering portions of the side faces enclosing the periphery of the collection space that are not covered by the fixed peripheral side section; a transition section that transitions the lid section to enable the lid section to adopt a closed state with respect to the fixed peripheral side section in which the lid section is close to or abutting the fixed peripheral side section and the collection space is closed, and to adopt an open state with respect to the fixed peripheral side section in which at least a portion of the lid section is separated from the fixed peripheral side section and the collection space is opened; a transfer section that transfers the medium between an interior and an exterior of the collection space; and a conveyance section that conveys the medium, wherein the transfer section transfers the medium between the conveyance section and the collection space.

The medium handover device and the medium processing device of the present aspects thereby enable quietness and safety to be secured in the closed state when transferring the medium using the transfer section, and enable the medium to be removed from the collection space or inserted into the collection space in the open state while also enabling the operator to see the medium inside the collection space from not only the side of the opposing face, but also from the side of the adjacent face.

Effects of Invention

The present aspects enables quietness and safety to be secured in the closed state when transferring the medium using the transfer section, and enables the medium to be removed from the collection space or inserted into the collection space in the open state while also enabling the operator (user) to see the medium inside the collection space from not only the side of the opposing face, but also from the side of the adjacent face. The present aspects thereby enable a medium handover device and a medium processing device enabling improved visibility of a medium exchanged with a user.

DESCRIPTION OF EMBODIMENTS

Explanation follows regarding exemplary embodiments, with reference to the drawings.

1. First Exemplary Embodiment

1-1. External Configuration of Banknote Processing Device

Figure 1:
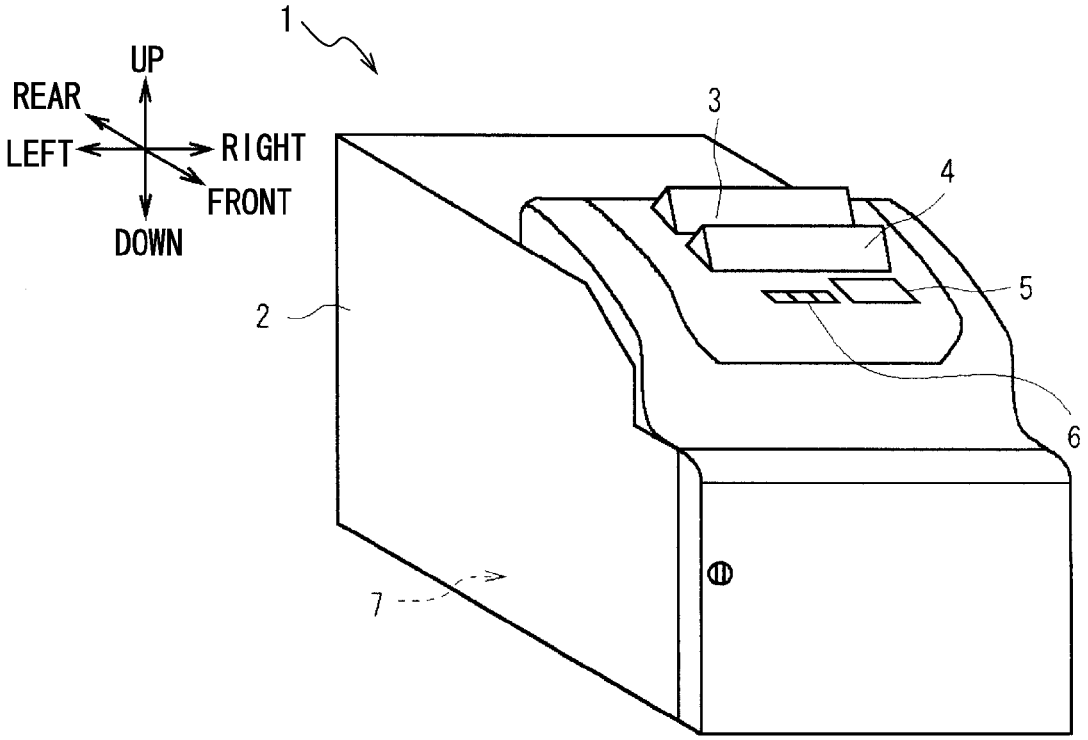
FIG. 1 is a schematic perspective view illustrating an external configuration of a banknote processing device.

First, explanation follows regarding a first exemplary embodiment. FIG. 1 illustrates an external configuration of a banknote processing device 1. The banknote processing device 1 is a service counter cash processing device installed at a service counter of a financial institution or the like, and an operator (user) such as a customer service assistant at the service counter operates the banknote processing device 1 to perform pay-in and pay-out processing of banknotes for a customer.

The banknote processing device 1 includes a pay-in section 3, a pay-out section 4, a display section 5, and an operation section 6, at an upper face of a casing 2 formed in a rectangular block shape overall.

The pay-in section 3 is mainly configured for paying in banknotes. When banknotes are inserted by the user, the pay-in section 3 takes the banknotes inside the banknote processing device 1.

The pay-out section 4 is mainly configured for paying out banknotes. Configuration is made such that banknotes conveyed from inside the banknote processing device 1 are collected inside the pay-out section 4 to be removed by the user.

The display section 5 is, for example, a liquid crystal display, and displays menu screens, result screens for various processing, and the like. The operation section 6 is, for example, configured from buttons, and accepts operation of the banknote processing device 1.

In the banknote processing device 1, the display section 5 and the operation section 6 are provided separately; however, the display section 5 and the operation section 6 may be provided as a single unit employing, for example, a liquid crystal display with a touch sensor (known as a touch panel).

A controller 7 is configured around a central processing unit (CPU), not illustrated in the drawings, and loads and executes specific programs from ROM, flash memory or the like, not illustrated in the drawings, to perform various processing such as pay-in processing and pay-out processing.

The controller 7 internally houses a storage section configured by Random Access Memory (RAM), a hard disk drive, flash memory or the like, and stores various data in the storage section.

The banknote processing device 1 is moreover connected to terminals in the financial institution, and to a host computer, through a network via a communication processor, not illustrated in the drawings. As well as exchanging various data with the terminals and host computer, the banknote processing device 1 is capable of being operated from the terminals.

In the following explanation, the front (anterior) side is defined as a front face side of the banknote processing device 1, from which display contents of the display section 5 can be properly read, and the opposite side thereto is defined as the rear side. The left side and the right side are defined as the left and right as viewed from the front side, and the upper side and lower side are defined in similar terms.

Figure 20:
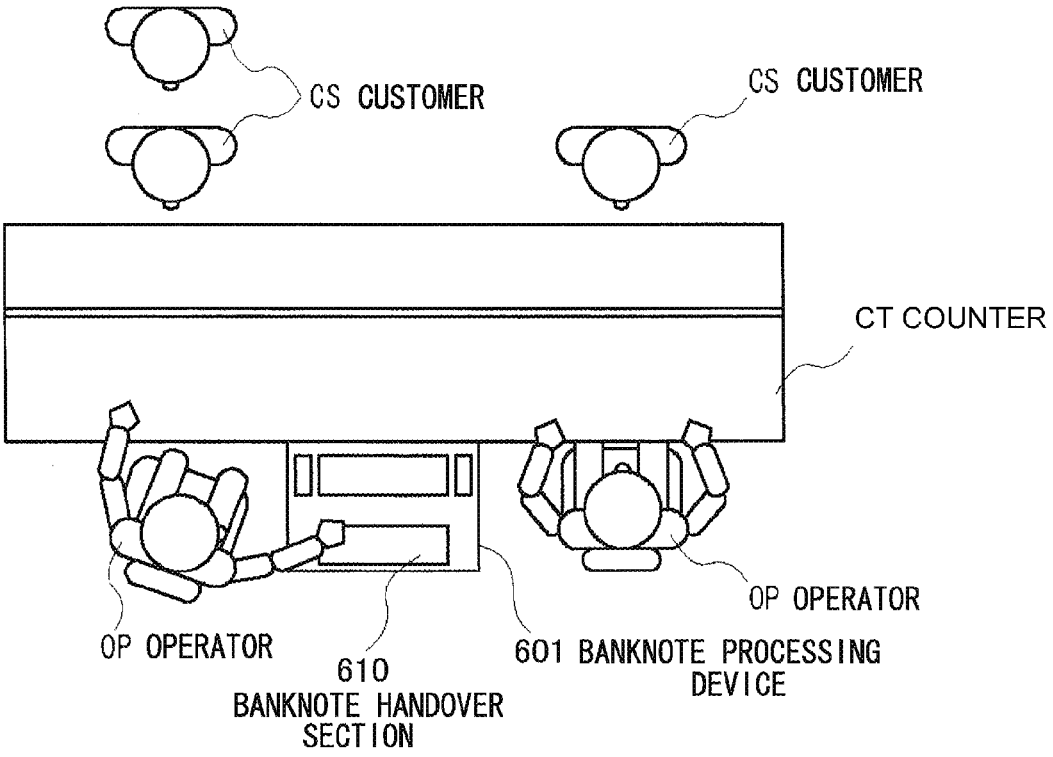
FIG. 20 is a schematic view illustrating a banknote processing device in use at a service counter.

Similarly to the conventional banknote processing device 601 (FIG. 20), the banknote processing device 1 is installed at a service window of a financial institution or the like, with a user seated in a chair adjacent to the banknote processing device 1, on the right side or the left side.

1-2. Internal Configuration of Banknote Processing Device

Figure 2:
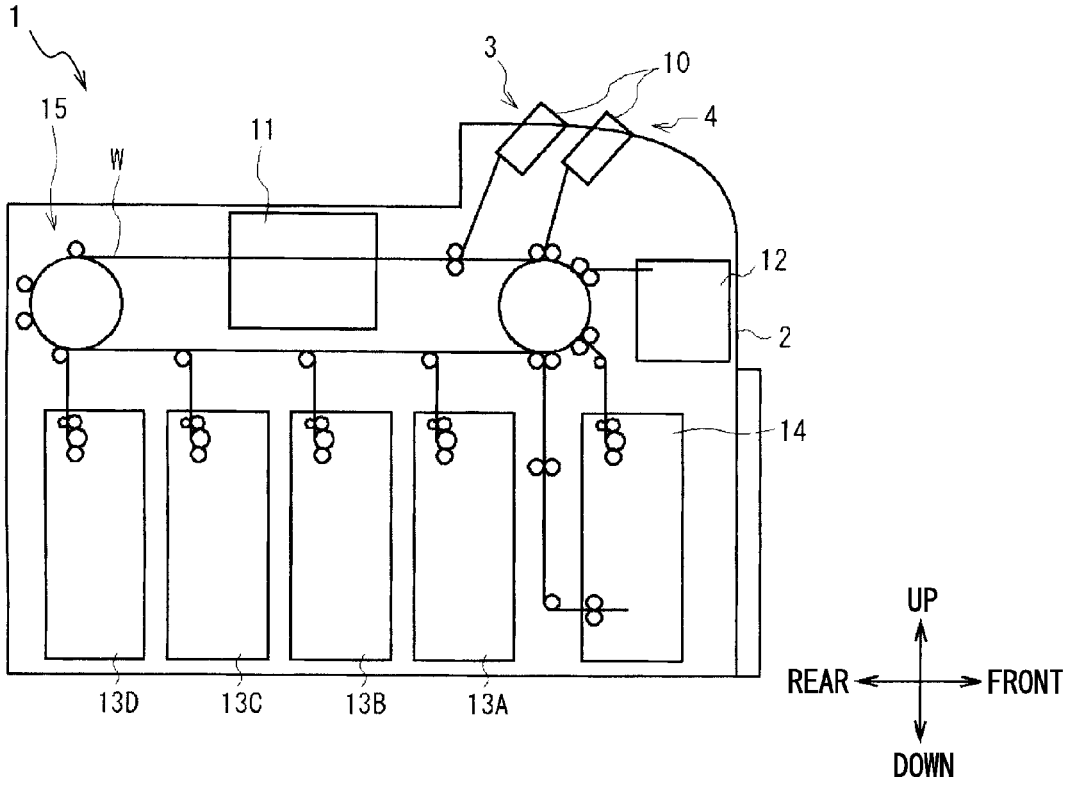
FIG. 2 is a schematic view illustrating an internal configuration of a banknote processing device.

Next, explanation follows regarding internal configuration of the banknote processing device 1, with reference to FIG. 2. In addition to the controller 7 mentioned above, a classification section 11, a temporary retention section 12, banknote cassettes 13A to 13D, a reject box 14, and a conveyance section 15 are provided inside the casing 2 of the banknote processing device 1.

The pay-in section 3 and the pay-out section 4 are provided in a front-rear direction at a location further toward the front than the center of an upper portion inside the casing 2, such that the pay-in section 3 is at the rear side and the pay-out section 4 is at the front side.

The pay-out section 4 is configured by a banknote handover section 10 that hands over banknotes to the user. The banknote handover section 10 is configured to collect banknotes conveyed from inside the device, to be removed by the user.

The classification section 11 is installed at a lower rear side of the pay-in section 3, and classifies banknotes conveyed by the conveyance section 15 into normal banknotes that may be transacted, and reject banknotes that may not be transacted, based on such factors as denomination, authenticity, degree of wear, running state and so on. The classification section 11 outputs the classification results to the controller 7.

The temporary retention section 12 is installed at a lower front side of the pay-out section 4, and temporarily internally retains banknotes conveyed by the conveyance section 15, and feeds out the retained banknotes to the conveyance section 15 one note at a time.

The reject box 14 is installed at the frontmost side of a lower portion inside the casing 2, and behind the reject box 14, the banknote cassettes 13A, 13B, 13C, and 13D are installed in a row in this sequence, from the front side to the rear side.

The banknote cassettes 13A to 13D each internally store banknotes in a collected state, and are each assigned with a denomination.

Inside the banknote cassettes 13A to 13D, banknotes (normal banknotes) conveyed by the conveyance section 15 are internally stored overlapping each other in the up-down direction. The banknote cassettes 13A to 13D also feed out and pass the stored banknotes to the conveyance section 15 one note at a time.

The reject box 14 internally stores reject banknotes conveyed by the conveyance section 15.

The conveyance section 15 is configured by various rollers and belts disposed along a conveyance path W linking the respective sections inside the casing 2, as well as by gears and motors and the like that drive them. Note that only some of the components configuring the conveyance section 15 are schematically illustrated in FIG. 2.

The conveyance section 15 is installed with conveyance path switching mechanisms, not illustrated in the drawings, at branch points along the conveyance path W. The conveyance path switching mechanisms switch the conveyance destinations of banknotes based on control by the controller 7.

During pay-in processing by the thus configured banknote processing device 1, first, the user inserts banknotes into a banknote handover section 10 of the pay-in section 3, and the banknotes are separated and conveyed out in sequence to the conveyance section 15, one note at a time. The conveyance section 15 conveys the banknotes in sequence to the classification section 11 along the conveyance path W.

The classification section 11 classifies the banknotes one note at a time, and outputs the classification results to the controller 7. When this has been performed, the controller 7 determines the conveyance destination for each banknote based on the classification results acquired from the classification section 11, namely based on whether each banknote is a normal banknote or a reject banknote.

Normal banknotes are conveyed to the temporary retention section 12 by the conveyance section 15 and temporarily retained, after which they are again conveyed to the classification section 11 to identify the denomination, and conveyed to the banknote cassettes 13A to 13D for storage according to denomination. Reject banknotes are conveyed to the reject box 14 by the conveyance section 15 for storage.

During pay-out processing in the banknote processing device 1, a pay-out amount instruction is received from a terminal or the like, not illustrated in the drawings, and based on control by the controller 7, banknotes are sequentially fed out from the banknote cassettes 13A to 13D to the conveyance section 15 in denominations and numbers making up the pay-out amount.

After the classification section 11 has classified the banknotes that have been fed out by denomination, degree of wear, and the like, the conveyance section 15 sequentially passes the banknotes to the banknote handover section 10 of the pay-out section 4. The banknote handover section 10 of the pay-out section 4 collects the banknotes passed from the conveyance section 15 to be removed by the user.

The banknote processing device 1 is thus configured to dispense banknotes from the banknote handover section 10 configuring the pay-out section 4 during the pay-out processing.

1-3. Banknote Handover Section Configuration

Next, explanation follows regarding configuration of the banknote handover section 10. As illustrated in the external view of FIG. 3, the banknote handover section 10 has an overall rectangular block shape that is long in the left-right direction, and short in the front-rear direction, and is rotated clockwise as viewed from the left side. The banknote handover section 10 is broadly divided into a frame 21 at the lower side and a shutter 22 at an upper side.

Namely, the banknote handover section 10 is attached to the casing 2 (FIG. 1, FIG. 2) such that, out of edge lines along three directions configuring the rectangular block shape, the longest edge line runs along the left-right direction, and the other two edge lines are respectively inclined at a specific angle θ (for example, approximately 30°) with respect to the up-down direction and the front-rear direction.

In the following explanation, as viewed from the left side, the directions inclined clockwise by the angle θ with respect to the front direction and the rear direction are respectively referred to as the front inclined direction and the rear inclined direction, and the directions inclined by the angle θ clockwise with respect to the upward direction and the downward direction are respectively referred to as the upward inclined direction and the downward inclined direction.

Figure 4A:
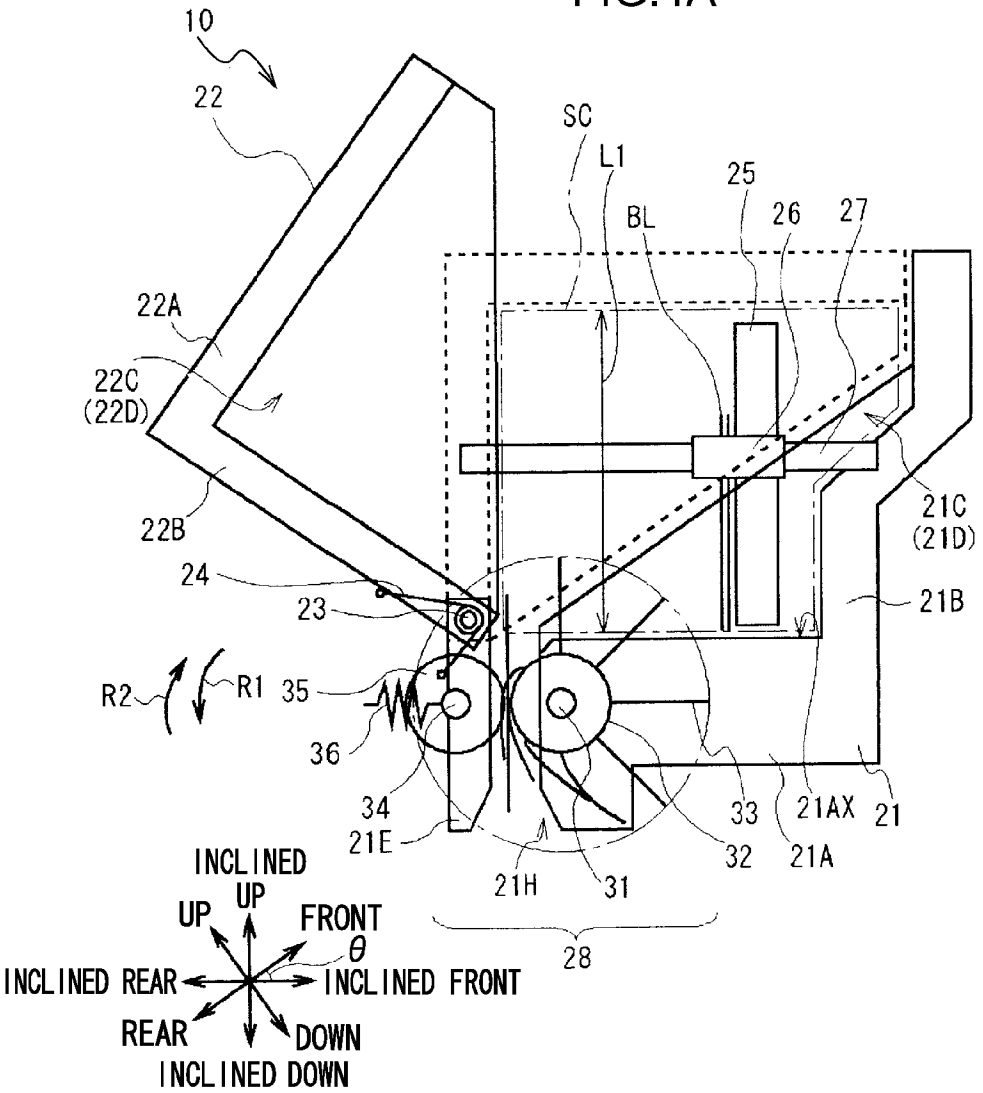
FIG. 4A is a schematic side view from the left illustrating a configuration of the banknote handover section according to the first exemplary embodiment.
Figure 4B:
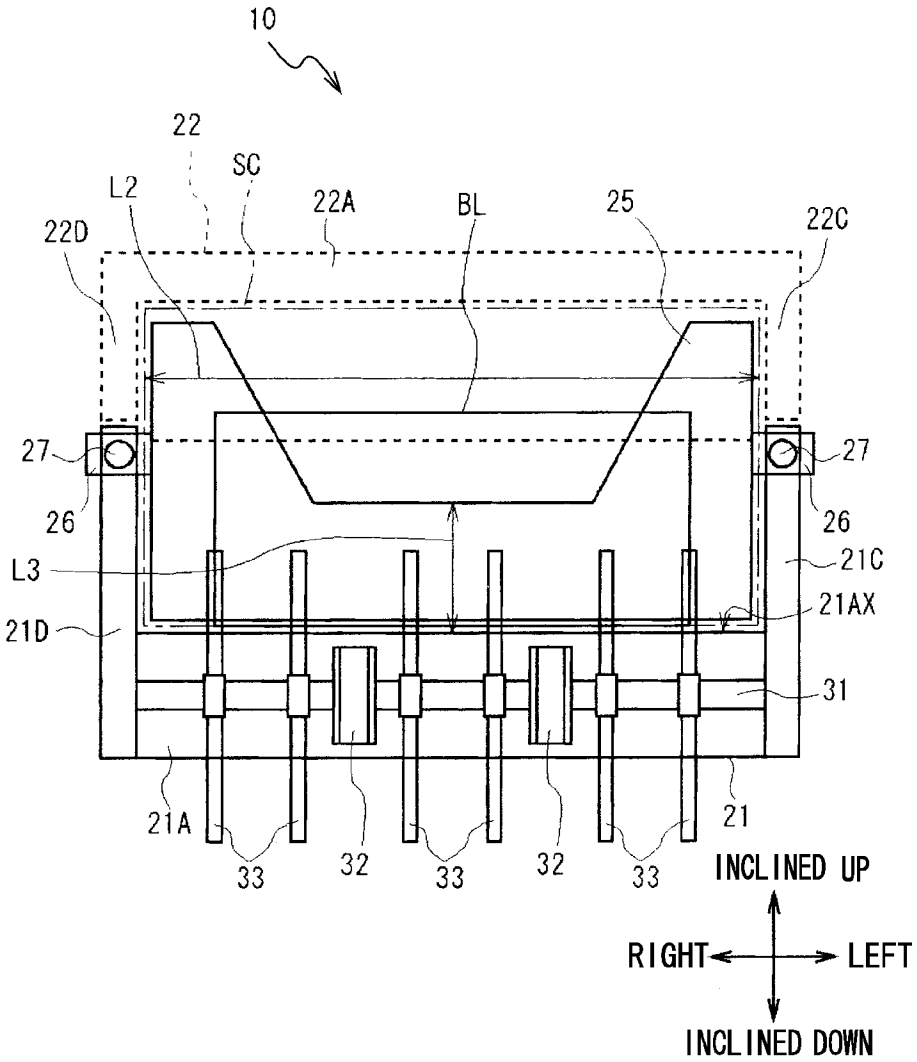
FIG. 4B is a schematic side view from the rear illustrating a configuration of the banknote handover section according to the first exemplary embodiment.

FIG. 4A and FIG. 4B respectively illustrate a left side view and a rear side view of the banknote handover section 10. For ease of explanation, each component is illustrated schematically in FIG. 4A and FIG. 4B, and some components are illustrated transparently. In FIG. 4A and FIG. 4B, the upward inclined direction and the downward inclined direction are respectively illustrated as the upward direction and the downward direction in the drawings.

The frame 21 is shaped as a hollow rectangular block shape from which an upper face, an upper portion of a rear side face, and approximately the upper side halves of left and right side faces have been cut away. The frame 21 is open at the cut-away portions, namely at substantially the entire inclined upper side, an upper portion of the inclined rear side, and approximately the upper side halves of the left and right side faces.

The frame 21 is thus configured by a lower portion 21A serving as a medium support section at an inclined lower side, a front side portion 21B at the inclined front side, a left side portion 21C at the left side, a right side portion 21D at the right side, and a rear side portion 21E at the inclined rear side.

The shutter 22 is configured by: an upper portion 22A that is a side face at the cut-away portion of the hollow rectangular block shape, namely a side face on the inclined upper side, serving as an opposing side face; a rear portion 22B at an upper portion of the inclined rear side, and a right-angled triangle shaped left side portion 22C and right side portion 22D configuring approximately the upper side halves of the left and right side faces, serving as adjacent side faces.

A collection space SC that is a rectangular block shaped space slightly smaller than the external profile of the banknote handover section 10 can therefore be formed inside the banknote handover section 10 when the shutter 22 is positioned at the upper side so as to fit together with the cut-away portion of the frame 21.

Banknotes BL are collected in the collection space SC in an upright state in which the sheet faces face toward the front inclined direction and the rear inclined direction, and the long edges of the banknotes BL abut a bottom face 21AX of the lower portion 21A.

The sizes, namely the lengths of the long edges and the short edges (referred to below as the long edge length and the short edge length respectively), of the banknotes BL handled by the banknote processing device 1 (FIG. 1), often vary depending on the denomination.

Accordingly, a length L1 (FIG. 4A) of the collection space SC in a direction along the upward inclined direction and the downward inclined direction (referred to below as the up-down inclined direction) is set longer than the short edge length of any of the banknotes BL handled by the banknote processing device 1 (FIG. 1). A length L2 (FIG. 4B) of the collection space SC in the left-right direction is set longer than the long edge length of any of the banknotes BL handled by the banknote processing device 1.

An upper portion of the front side portion 21B of the frame 21 is bent in a crank shape toward the front, thereby extending an upper portion of the collection space SC toward the front.

A plate shaped stage 25 is formed in the collection space SC with the plate faces facing toward the front-rear inclined direction. The stage 25 is formed in a plate shape that is thin in the front-rear inclined direction and long in the left-right direction. The stage 25 is largely cut away in a trapezoidal shape over a broad range spanning from the center of an upper side to the vicinity of the left and right ends (FIG. 4B).

Note that a length L3 from an upper end of a central portion of the stage 25 to the bottom face 21AX that is the upper face of the lower portion 21A of the frame 21 is shorter than the short edge length of the banknote BL with the shortest short edge length handled by the banknote processing device 1.

Thus, in the banknote handover section 10, even when a banknote BL with the shortest short edge length is collected in the collection space SC, a central portion of the upper side long edge of the banknote BL can be exposed to the upper side of the upper edge of the stage 25.

Small rectangular block shaped supports 26 are attached to both the left and right ends of the stage 25. Shaft holes configured by circular holes or elongated holes are formed penetrating the supports 26 in the front-rear inclined direction.

Long, thin, circular rod shaped sliding shafts 27 extending along the front-rear inclined direction are respectively provided on the left and right of the frame 21. The sliding shafts 27 pass through the shaft holes in the supports 26.

The supports 26 are supported by springs, not illustrated in the drawings. This enables the stage 25 to move along the front-rear inclined direction, while sliding the respective supports 26 along the respective sliding shafts 27 under the weight of the banknotes BL, when banknotes BL are placed on the stage 25.

A conveyance path 21H, configured by a long, thin, slit shaped elongated hole extending from left to right, is formed penetrating a lower rear side of the frame 21 in the up-down inclined direction.

A discharge section 28 that conveys banknotes BL along the conveyance path 21H and discharges the banknotes BL into the collection space SC is provided at the inclined front side and the inclined rear side of the conveyance path 21H at a lower rear side portion of the frame 21.

The discharge section 28, serving as a transfer section, is configured by a drive shaft 31, feed rollers 32, and paddle wheels 33, each disposed at the inclined front side of the conveyance path 21H, and by an idle shaft 34, driven rollers 35, and springs 36, each disposed at the inclined rear side of the conveyance path 21H, so as to sandwich the conveyance path 21H in the front-rear inclined direction.

The drive shaft 31 is formed in a long, thin, circular rod shape, and is positioned further to the inclined front side than an inner face of the conveyance path 21H, with its axial center running along the left-right direction. The drive shaft 31 is rotatably supported by shaft bearings, not illustrated in the drawings, and an actuator, not illustrated in the drawings, transmits drive force to the drive shaft 31 to rotate the drive shaft 31 in the clockwise direction and the counterclockwise direction in the drawing.

The feed rollers 32 are each formed in a thin circular columnar shape, with the axial center along the left-right direction. The feed rollers 32 are inserted onto the drive shaft 31 at two locations, each having a specific distance from the left-right center of the drive shaft 31. Part of each of the feed rollers 32 is exposed to the inside of the conveyance path 21H through specific holes formed at the inner face of the conveyance path 21H. A high friction material with a higher coefficient of friction with respect to the banknotes BL than other portions is applied to part of the circumferential face of each of the feed rollers 32.

The paddle wheels 33 are each configured by a central portion formed in a small, thin, circular disk shape, and plural tongues that extend out from the central portion in a radiating pattern. The tongues are formed from a flexible material, and are each formed in a rod shape, or in a long, thin plate shape.

The paddle wheels 33 are inserted onto the drive shaft 31 at a total of six locations; at two locations between the feed rollers 32, and at two locations each on the respective left and right outsides of the feed rollers 32, with appropriate separations between each other. Part of each of the paddle wheels 33 is exposed to the inside the conveyance path 21H and the collection space SC through specific holes formed spanning from the inner face of the conveyance path 21H to the bottom face 21AX of the frame 21.

The idle shaft 34 is formed in a long, thin, circular rod shape, similarly to the drive shaft 31, and is positioned facing the drive shaft 31 across the conveyance path 21H. Namely, the idle shaft 34 is provided at the inclined rear side of the drive shaft 31. The idle shaft 34 is supported by a support mechanism, not illustrated in the drawings, so as to be capable of displacement in the front-rear inclined direction.

The driven rollers 35 are each formed in a thin circular columnar shape with the axial center running along the left-right direction, similarly to the feed rollers 32. The driven rollers 35 are inserted onto the idle shaft 34 at two locations facing the feed rollers 32, and are capable of rotating freely about the idle shaft 34. Part of each of the driven rollers 35 is exposed to the inside of the conveyance path 21H through specific holes formed at the inner face of the conveyance path 21H.

The springs 36 are compressible coil springs, attached to the frame 21 at an inclined rear side end, and attached to the idle shaft 34 at an inclined front side end.

The springs 36 are compressed from their natural state in the front-rear inclined direction, such that a recovery force toward the front inclined direction acts on the idle shaft 34, thereby pressing the driven rollers 35 against the feed rollers 32.

The thus configured discharge section 28 enables banknotes BL to be conveyed out toward the upward inclined direction and the downward inclined direction by nipping each banknote BL between the feed rollers 32 and the driven rollers 35 and rotation-driving the feed rollers 32.

Figure 3:
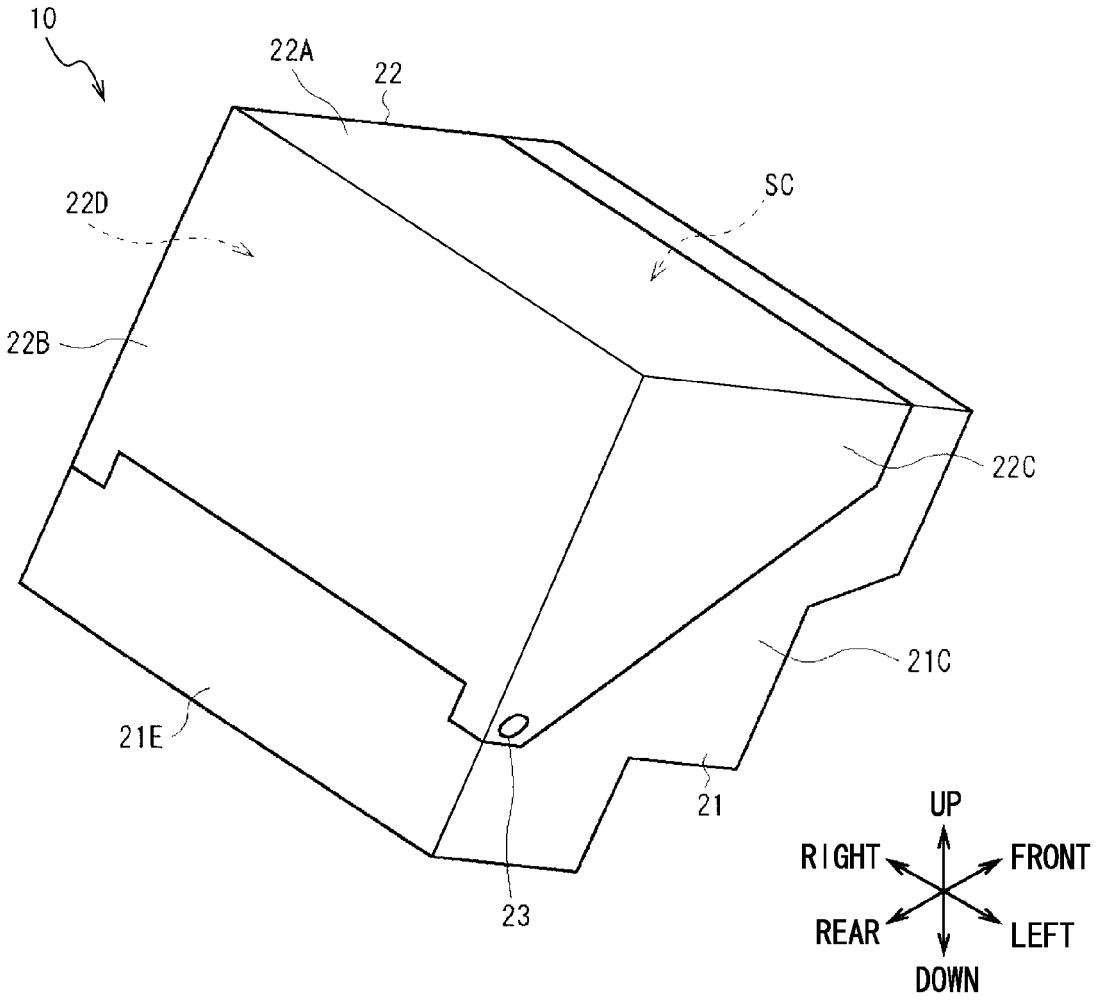
FIG. 3 is a schematic perspective view illustrating a configuration of a banknote handover section according to a first exemplary embodiment.

Note that as illustrated in FIG. 3, both left and right ends of a rear face of the shutter 22 are attached to the frame 21 through a turn shaft 23.

An actuator, not illustrated in the drawings, transmits drive force to the turn shaft 23, thereby turning the shutter 22 with respect to the frame 21 about a turn axis in the left-right direction, in an opening direction R1 that is the counterclockwise direction as viewed from the left, or in a closing direction R2 that is the opposite direction thereto (FIG. 4A). The frame 21 restricts the turning range of the shutter 22 to within a specific turning range.

A spring 24 that biases the shutter 22 in the closing direction R2 with respect to the frame 21 is provided in the vicinity of the turn shaft 23. The spring 24 is configured by a torsion spring, and is designed to produce a rather weak biasing force of a level that enables a user to use a fingertip or the like to turn the shutter 22 in the opening direction R1 against the biasing force.

In the thus configured banknote handover section 10, when the shutter 22 has been turned in the closing direction R2 by the turn shaft 23, the shutter 22 is positioned at the upper side of the frame 21, placing the collection space SC in a closed state as illustrated by dotted lines in FIG. 4A. This state of the shutter 22 is referred to below as the closed state.

In the closed state, as illustrated in FIG. 3, the shutter 22 closes the upper side and the left and right upper portions of the collection space SC, enabling the collection space SC to be isolated from the outside.

The shutter 22 is configured from a resin material with high light transmissivity, such that the user is able to see the interior of the collection space SC in the closed state.

In the banknote handover section 10, when the shutter 22 has been turned in the opening direction R1 by the turn shaft 23, the inclined front side of the shutter 22 is pulled well back from the frame 21 to place the inclined upper side of the collection space SC in an open state, as illustrated by solid lines in FIG. 4A. This state of the shutter 22 is referred to below as the open state.

Figure 5:
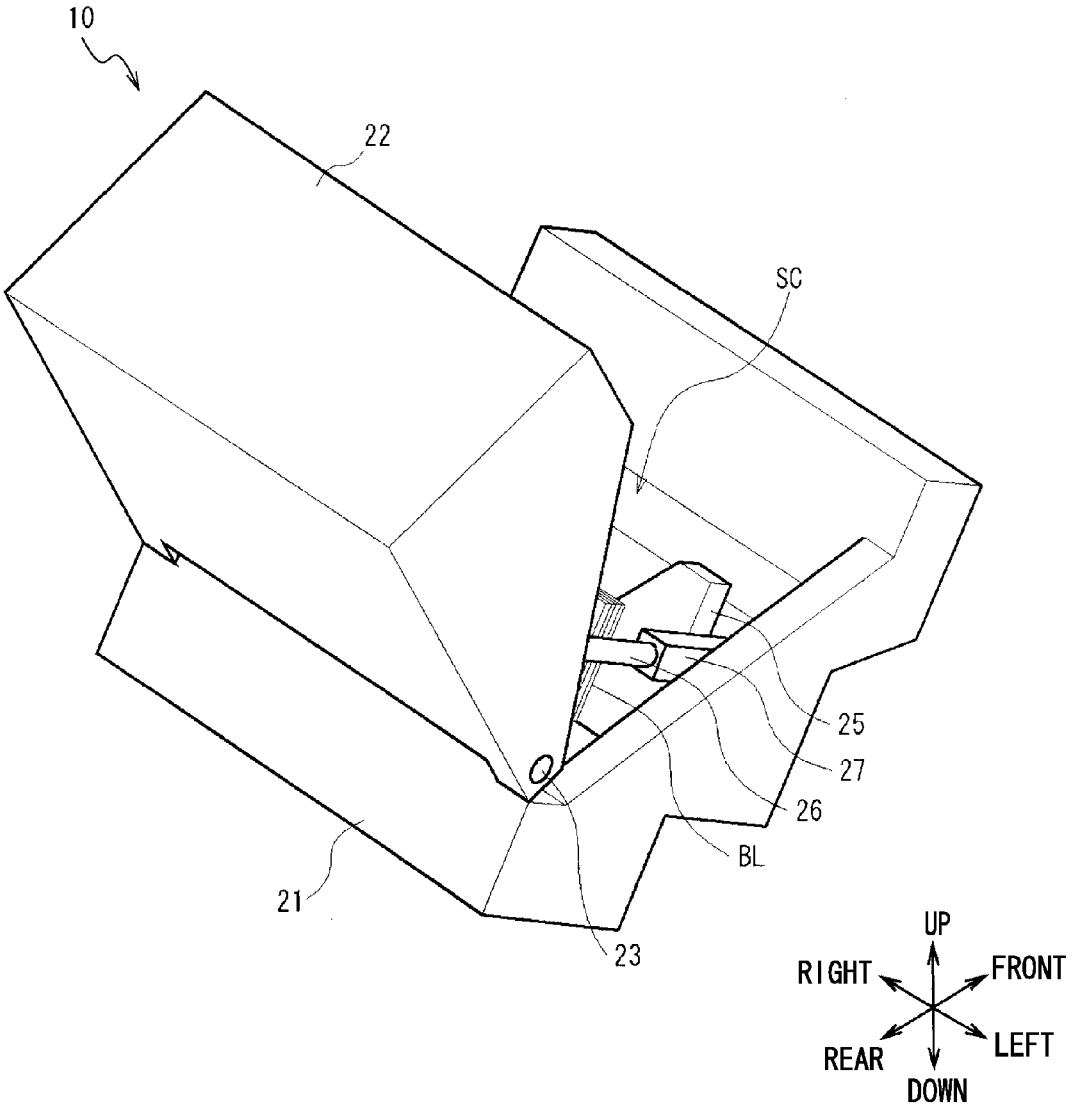
FIG. 5 is a schematic perspective view illustrating a configuration of the banknote handover section according to the first exemplary embodiment.

In the open state, as illustrated in FIG. 5 corresponding to FIG. 3, the shutter 22 is open at the inclined upper side, as well as the left and right upper portions, of the collection space SC, enabling the collection space SC to be placed in communication with the space outside.

In the banknote handover section 10, the collection space SC can thus be closed off in the closed state of the shutter 22, and, by turning the shutter 22 with respect to the frame 21 using the turn shaft 23, the inclined upper side and the left and right upper portions of the collection space SC can be opened up in the open state of the shutter 22.

1-4. Operation and Effects

In the configuration described above, during pay-out processing, based on control by the controller 7, the banknote handover section 10 according to the first exemplary embodiment first turns the shutter 22 to the closed state using the turn shaft 23 (FIG. 3, FIG. 4A).

Next, the banknote handover section 10 uses the discharge section 28 to sequentially convey banknotes BL passed in sequence from the conveyance section 15 (FIG. 2) toward the upward inclined direction to be discharged into the collection space SC.

Accompanying this, the banknote handover section 10 uses the paddle wheels 33 to pat down the banknotes BL discharged into the collection space SC toward the front inclined direction, and gradually moves the stage 25 toward the inclined front side. The banknotes BL are thus sequentially overlapped with one another and collected at an inclined rear side face of the stage 25 inside the collection space SC, with the long edges abutting the bottom face 21AX of the frame 21.

Once all of the banknotes BL to be paid out have been collected in the collection space SC, the banknote handover section 10 then uses the turn shaft 23 to turn the shutter 22 to the open state (FIG. 4A, FIG. 5), enabling the user to remove the banknotes BL.

In this pay-out processing, when the banknote handover section 10 has placed the shutter 22 in the closed state, as illustrated in FIG. 3, the portion of the collection space SC that is not covered by the frame 21 is covered by the shutter 22, enabling the collection space SC to be isolated from the space outside.

The banknote handover section 10 thereby enables noise accompanying the operation of each section of the discharge section 28, and of conveyance of the banknotes BL, to be blocked, and also enables safety to be secured by preventing the fingers of the user, for example, from contacting the moving stage 25 or the like.

In the banknote handover section 10, in the open state of the shutter 22, the collection space SC is open not only at the inclined upper side, but also at the left side and the right side, as illustrated in FIG. 5.

The banknote handover section 10 thereby enables the user to view a broad range inside the collection space SC from the vantage point of a user in a seated posture in a chair adjacent to the right or adjacent to the left of the banknote processing device 1, namely from the diagonal top right and the diagonal top left. This thereby enables a removal operation of the banknotes BL to be performed with the banknotes BL visible inside the collection space SC.

Note that in some conventional banknote handover sections, the banknote handover section 610 described above (FIG. 19A and FIG. 19B) has been improved so as to raise the visibility of the collection space SC.

Figure 6A:
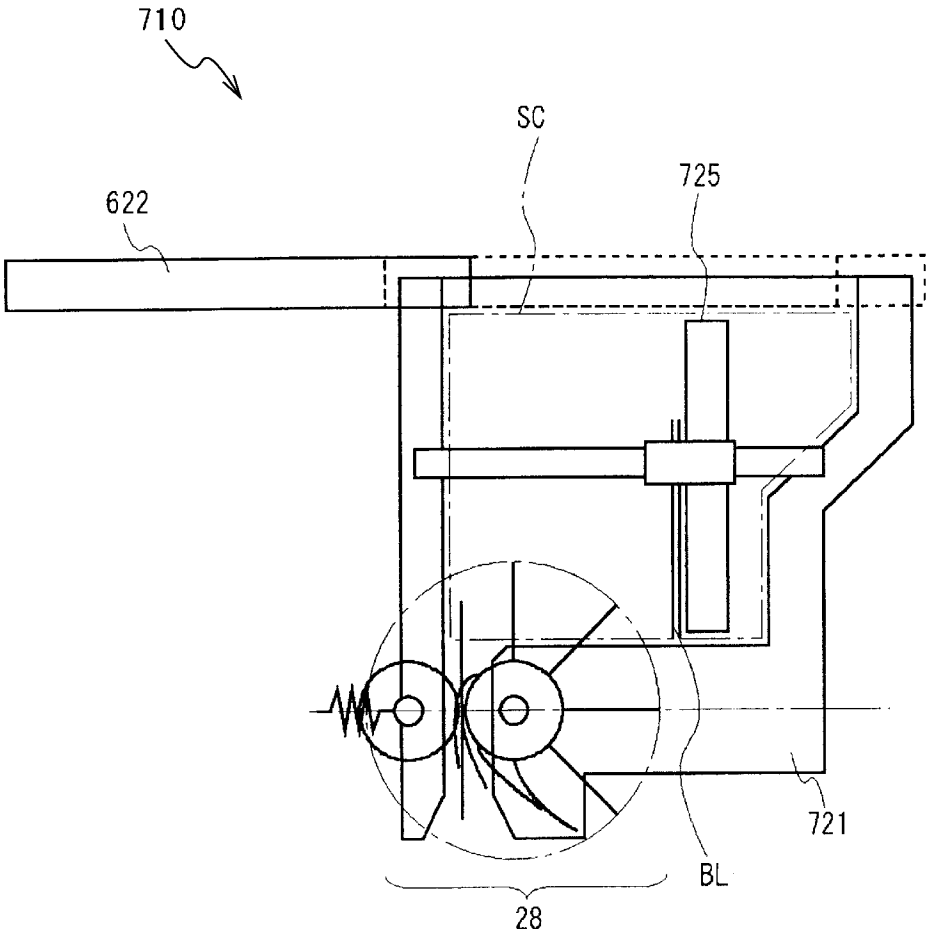
FIG. 6A is a schematic side view from the left illustrating a configuration of a conventional banknote handover section.
Figure 6B:
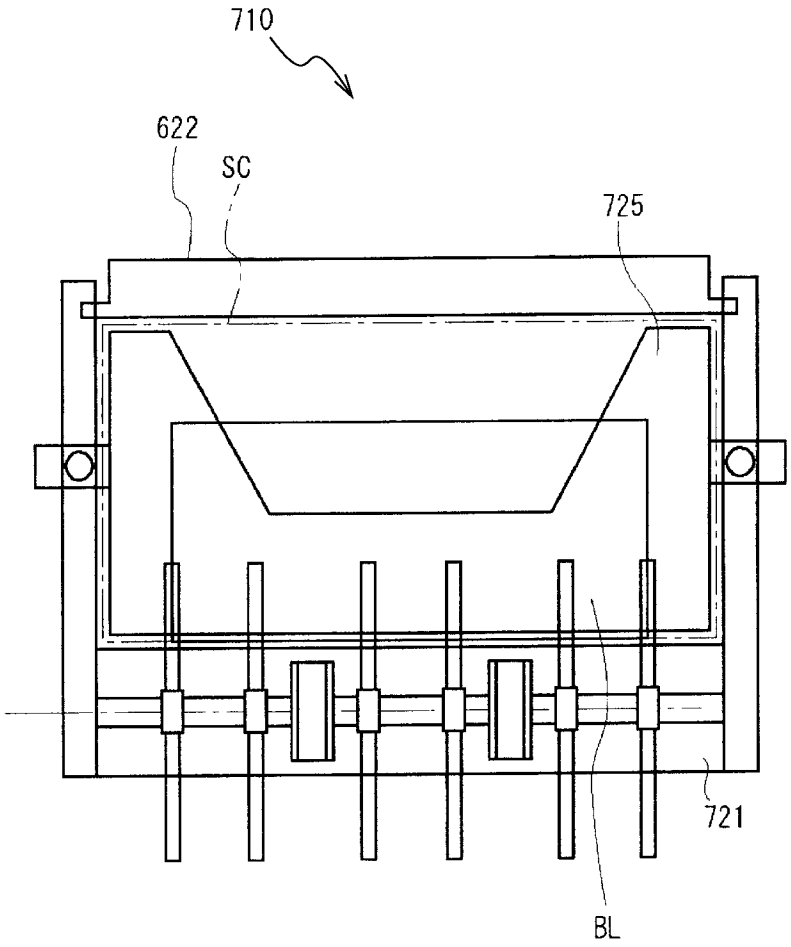
FIG. 6B is a schematic side view from the rear illustrating a configuration of the conventional banknote handover section.
Figure 19A:
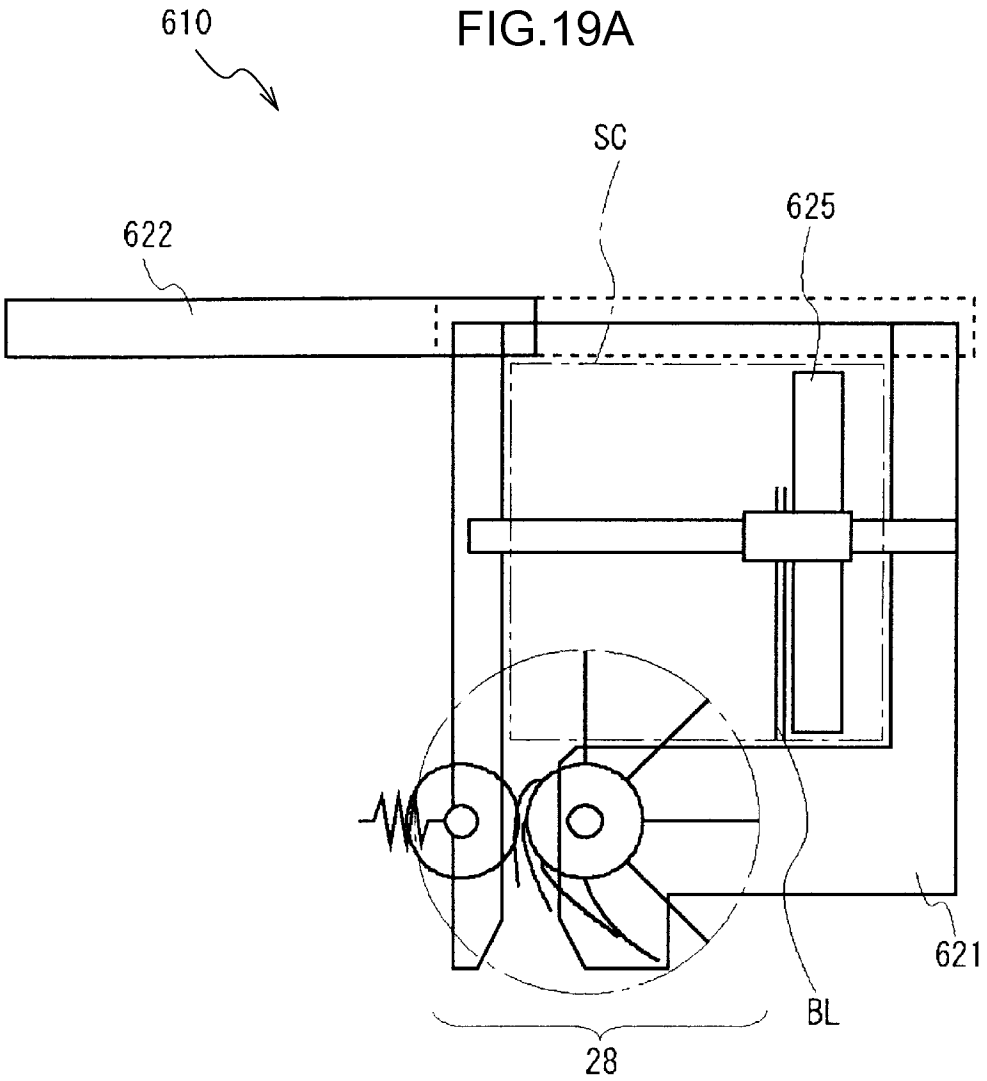
FIG. 19A is a schematic side view from the left illustrating a configuration of a conventional banknote handover section.
Figure 19B:
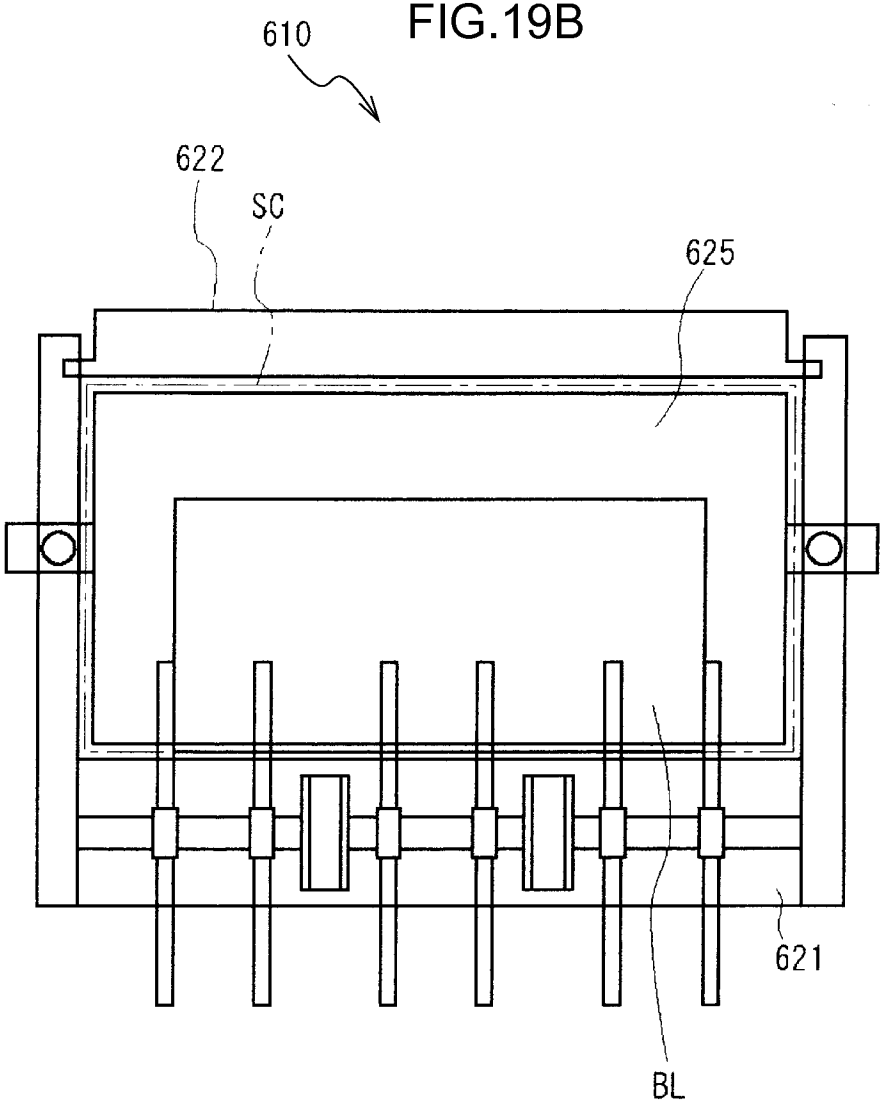
FIG. 19B is a schematic side view from the rear illustrating a configuration of the conventional banknote handover section.

For example, in FIG. 6A and FIG. 6B, corresponding to FIG. 19A and FIG. 19B, in a conventional banknote handover section 710, a shutter 622 only opens an upper face of the collection space SC, similarly to the conventional banknote handover section 610.

In the banknote handover section 710, an upper side portion of a front side face of a frame 721 is bent toward the front in a crank shape, and an upper side central portion of a stage 725 is largely cut away in a trapezoidal shape.

Compared to the banknote handover section 610 (FIG. 19A and FIG. 19B), the banknote handover section 710 enables increased visibility of the collection space SC from above from the front, and increased ease of operation in removing the banknotes BL. However, there is no difference to the visibility from above from the left and right, which remains low.

Figure 7A:
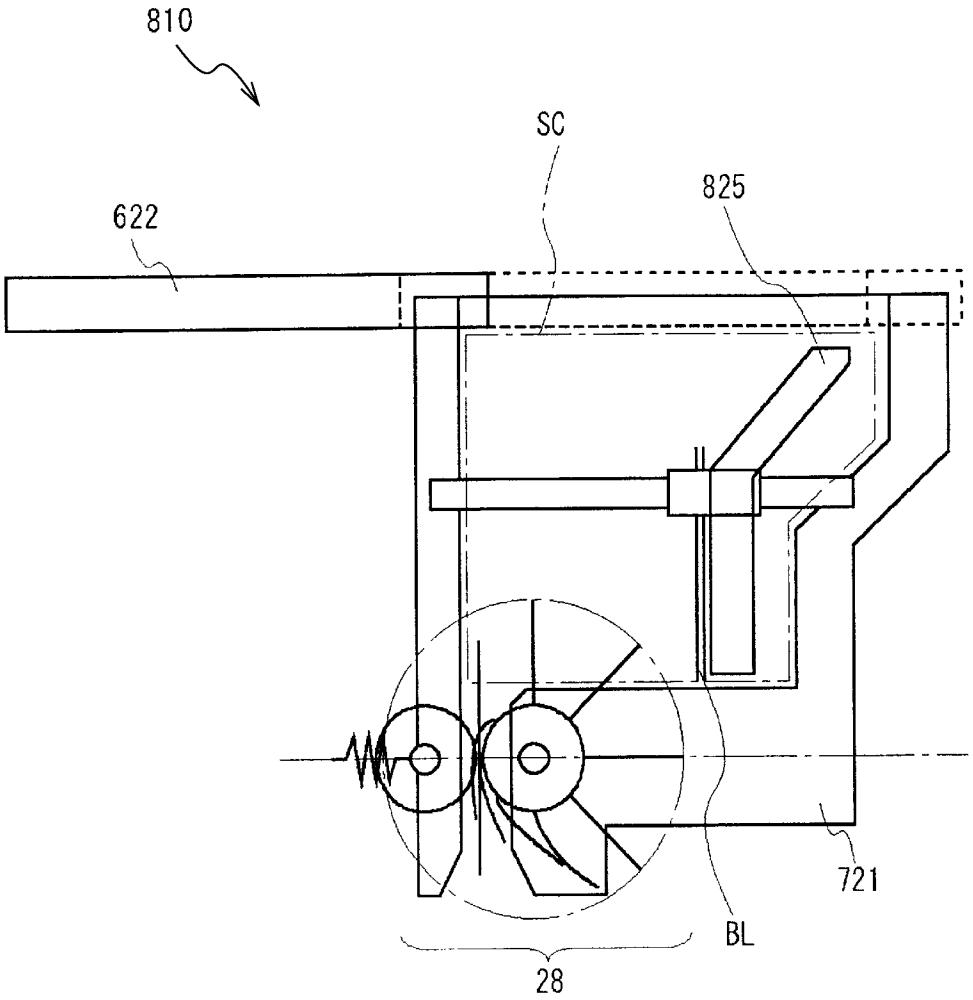
FIG. 7A is a schematic side view from the left illustrating a configuration of a conventional banknote handover section.
Figure 7B:
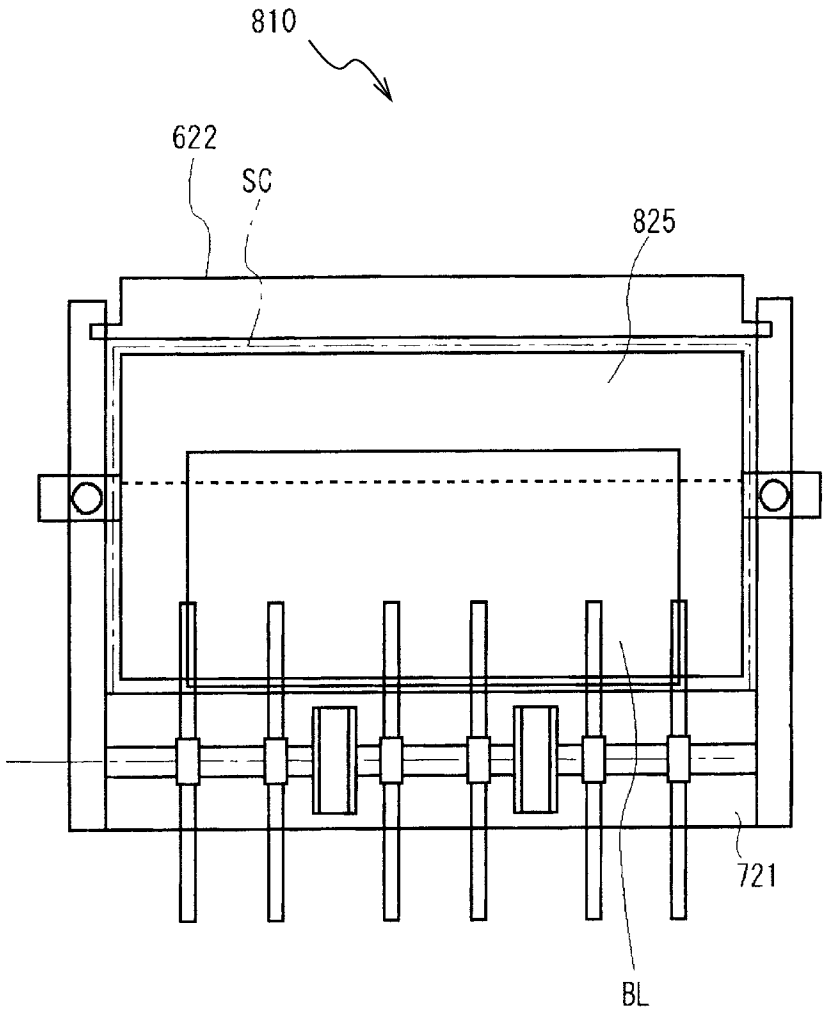
FIG. 7B is a schematic side view from the rear illustrating a configuration of the conventional banknote handover section.

Further, as illustrated in FIG. 7A and FIG. 7B, corresponding to FIG. 19A and FIG. 19B, in a conventional banknote handover section 810, a shutter 622 only opens an upper face of the collection space SC, similarly to the conventional banknote handover section 610.

In the banknote handover section 810, an upper portion of a front face of a frame 721 is bent toward the front in a crank shape, and an upper portion of a stage 825 is tilted so as to bend diagonally toward the front.

Similarly to a banknote handover section 710, the banknote handover section 810 enables increased visibility of the collection space SC from above from the front, and increased ease of operation in removing the banknotes BL, compared to the banknote handover section 610 (FIG. 19A and FIG. 19B). However, there is still no difference to the visibility from above from the left and right, which remains low.

By contrast, in the banknote handover section 10 of the present exemplary embodiment, the left and right upper portions, namely the upper portions on the left and right of the collection space SC, are cut away from the frame 21, and the shutter 22 is provided with the left side portion 22C and the right side portion 22D on the left and right respectively. The banknote handover section 10 thereby enables a marked increase in visibility from upper left and upper right.

Similarly to the conventional banknote handover section 710 (FIG. 6A and FIG. 6B), the upper portion of the front face of the frame 21 of the banknote handover section 10 is bent toward the front in a crank shape, and the upper central portion of the stage 25 is largely cut away. The banknote handover section 10 thereby enables an increase in visibility from upper front, and increased ease of operation in removing the banknotes BL.

In the banknote handover section 10 according to the first exemplary embodiment configured as described above, a portion toward the inclined upper side and upper inclined rear side of the collection space SC, and approximately the upper halves of the left and right faces, are cut away from the frame 21. These portions are respectively covered by the upper portion 22A, rear portion 22B, left side portion 22C, and right side portion 22D of the shutter 22. The banknote handover section 10 is further configured to turn the shutter 22 with respect to the frame 21 using the turn shaft 23 at the inclined rear side. The banknote handover section 10 accordingly isolates the collection space SC from its surroundings when the shutter 22 is in the closed state, while enabling visibility of the collection space SC to be raised by opening up the inclined upper side, and the left and right upper portions when the shutter 22 is in the open state.

2. Second Exemplary Embodiment

Figure 8:
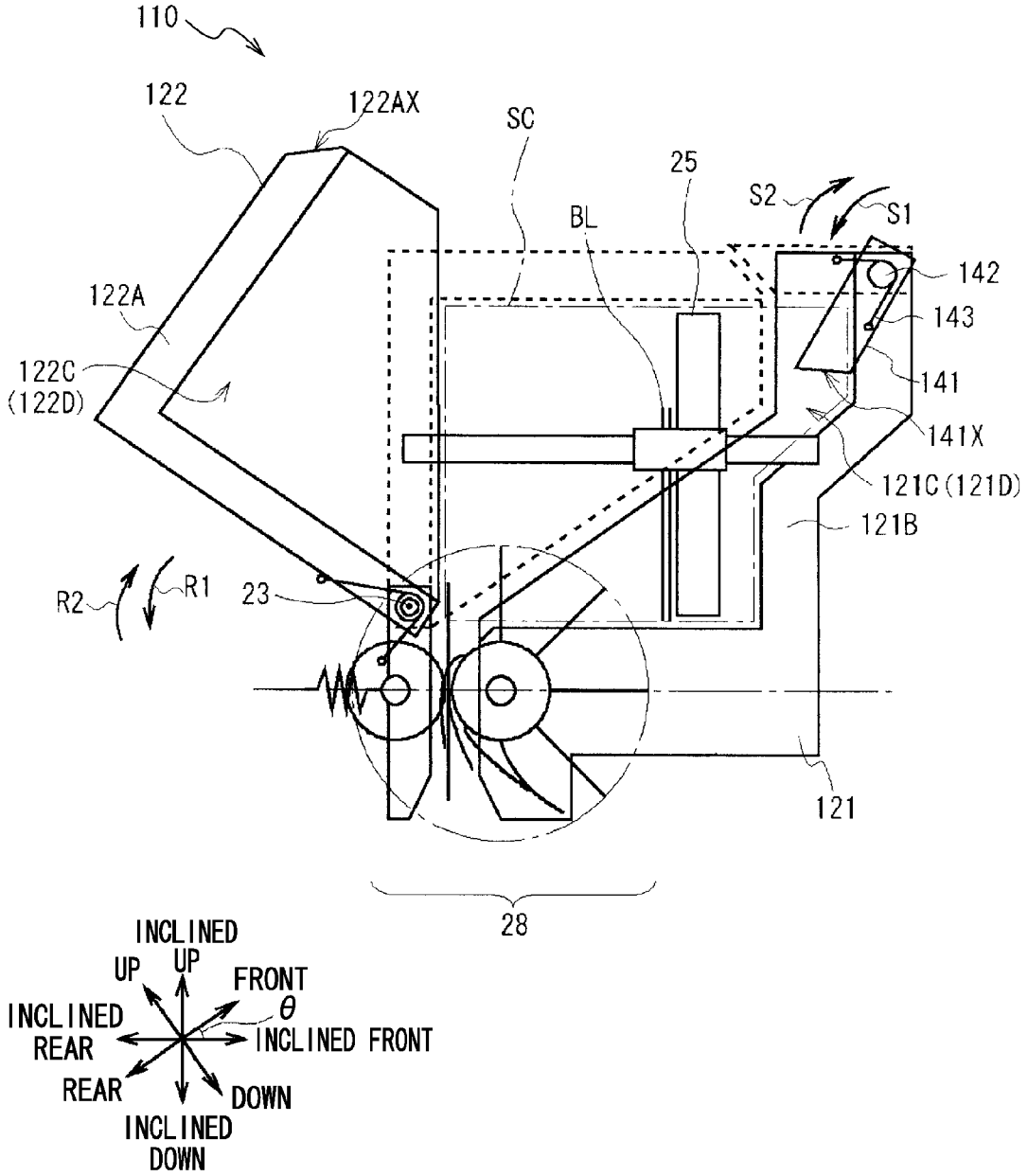
FIG. 8 is a schematic view illustrating a configuration of a banknote handover section according to a second exemplary embodiment.

As illustrated in FIG. 8, corresponding to FIG. 4A, in a second exemplary embodiment a banknote handover section 110 is employed, in the place of the banknote handover section 10, as the pay-out section 4 of the banknote processing device 1.

2-1. Banknote Handover Section Configuration

The banknote handover section 110 differs from the banknote handover section 10 of the first exemplary embodiment in that a frame 121 and a shutter 122 are provided in place of the frame 21 and the shutter 22, and that a second shutter 141, a turn shaft 142, and a spring 143 are added. Other portions are configured similarly to the banknote handover section 10 of the first exemplary embodiment.

Compared to the shutter 22 of the first exemplary embodiment, the shutter 122 has a shape that is partially trimmed back at a portion of an inclined front side in the closed state (illustrated by intermittent lines in the drawings).

Namely, an upper portion 122A of the shutter 122 is shorter in the front-rear inclined direction than the upper portion 22A of the shutter 22. A left side portion 122C and a right side portion 122D of the shutter 122 are also respectively cut away at portions corresponding to end portions at the inclined front side of the left side portion 22C and the right side portion 22D of the shutter 22, giving a trapezoidal shape.

An end face 122AX at the inclined front side of the upper portion 122A of the shutter 122 is tilted with respect to the up-down inclined direction such that the end face faces somewhat toward the inclined upper side.

The frame 121 is configured to cover the remainder of the left and right side portions of the collection space SC not covered by the shutter 122, and has a different shape to the frame 21 of the first exemplary embodiment.

Specifically, a left side portion 121C and a right side portion 121D of the frame 121 are respectively shaped such that only portions corresponding to the inclined front sides of the left side portion 21C and the right side portion 21D of the frame 21 extend toward the upward inclined direction.

In other words, the frame 121 has a shape in which respective portions corresponding to the remaining portions after portions corresponding to the left side portion 122C and the right side portion 122D of the shutter 122 have been removed from the left side portion 22C and the right side portion 22D of the shutter 22 of the first exemplary embodiment are joined to the left side portions 21C and right side portion 21D of the frame 21 of the first exemplary embodiment.

Similarly to the first exemplary embodiment, the shutter 122 is attached to the frame 121 so as to be capable of turning about the turn shaft 23.

The banknote handover section 110 is accordingly capable of transitioning the shutter 122 between the closed state, illustrated by intermittent lines in FIG. 8, and the open state, illustrated by solid lines in FIG. 8, by turning the shutter 122 with respect to the frame 121 using the turn shaft 23.

In addition to the above configuration, a second shutter 141 serving as a second lid section is attached at an upper end of a front side portion 121B of the frame 121 through a turn shaft 142.

The second shutter 141 is formed thin in the up-down inclined direction, and has a short plate shape in the front-rear inclined direction. The second shutter 141 covers the remaining portion of the inclined upper portions of the frame 121 not covered by the shutter 122.

In other words, the second shutter 141 corresponds to a remaining portion after a portion corresponding to the upper portion 122A of the shutter 122 has been removed from the upper portion 22A of the shutter 22 of the first exemplary embodiment.

An end face 141X at an inclined rear side of the second shutter 141 faces somewhat toward the inclined lower side, and is tilted with respect to the up-down inclined direction so as to correspond to the end portion 122AX of the upper portion 122A of the shutter 122.

The turn shaft 142 is configured similarly to the turn shaft 23, and supports the second shutter 141 so as to be capable of turning with respect to the frame 121 in an opening direction S1 that is the counterclockwise direction as viewed from the left, or in a closing direction S2 that is the opposite direction thereto. The frame 121 restricts the turning range of the second shutter 141 within a specific turning range.

The spring 143 is provided in the vicinity of the turn shaft 142 to bias the second shutter 141 in the closing direction S2 with respect to the frame 121.

When no external force is being applied, the spring 143 accordingly acts on the second shutter 141 to position the end portion 141X facing toward the inclined rear side at the upper side of the collection space SC, configuring a second closed state illustrated by the intermittent line in FIG. 8.

When the shutter 122 is in the closed state, the end portion 141X of the second shutter 141 abuts the inclined front end portion 122AX of the upper portion 122A of the shutter 122, thereby restricting turning of the second shutter 141 in the opening direction S1.

As illustrated by solid lines in FIG. 8, when an external force stronger than the biasing force of the spring 143 is applied in the downward inclined direction or the downward direction with the shutter 122 in the open state, the second shutter 141 turns from the second closed state toward the opening direction S1, placing the end portion 141X in a second open state facing toward the downward inclined direction.

When application of the external force ceases, the second shutter 141 turns toward the closing direction S2 under the action of the spring 143, eventually returning to the second closed state.

In this manner, the banknote handover section 110 can transition between the closed state and the open state by turning the shutter 122 with respect to the frame 121 using the turn shaft 23, and can transition between the second closed state and the second open state by turning the second shutter 141 with respect to the frame 121 using the turn shaft 142.

2-2. Operation and Effects

In the banknote handover section 110 of the second exemplary embodiment configured as described above, when the shutter 122 is placed in the closed state by, for example, turning the shutter 122 in the closing direction R2 with respect to the frame 121 using the turn shaft 23 based on control by the controller 7, the shutter 122 covers the collection space SC at the inclined upper side, and over a range spanning from intermediate points on the left and right upper side portions to the inclined rear side.

In this state of the banknote handover section 110, the second shutter 141 is biased in the closing direction S2 by the biasing force of the spring 143, such that the inclined front portion of the inclined upper side of the collection space SC is placed in the second closed state, covered by the second shutter 141.

In the banknote handover section 110, the collection space SC can accordingly be isolated from the space outside by the frame 121, the shutter 122 in the closed state, and the second shutter 141 in the second closed state.

Moreover, in the banknote handover section 110, the end portion 122AX of the upper portion 122A of the shutter 122 is positioned at the inclined lower side of the end portion 141X of the second shutter 141, thereby suppressing turning of the second shutter 141 even when applied with external force, and holding the second shutter 141 in the second closed state.

Thus, in the banknote handover section 110, similarly to the first exemplary embodiment, noise accompanying the operation of each section of the discharge section 28, conveyance of the banknotes BL, and the like can be blocked, and safety can be secured by preventing the fingers of the user, for example, from contacting the moving stage 25 or the like.

In the banknote handover section 110, the length of the shutter 122 in the front-rear inclined direction is made shorter than that of the shutter 22 of the first exemplary embodiment.

Accordingly, in the banknote handover section 110 the space required for the shutter 122 to turn about the turn shaft 23 can be made smaller than the space required for the shutter 122 to turn in the first exemplary embodiment, thereby enabling a reduction in the space that has to be kept clear during operation of the banknote processing device 1.

In the banknote handover section 110, based on control by the controller 7, the shutter 122 is turned in the opening direction R1 with respect to the frame 121 using the turn shaft 23, placing the end portion 122AX of the upper portion 122A well away from the end portion 141X of the second shutter 141 in the open state, and opening up the collection space SC at the inclined upper side and over a range spanning from intermediate points on the left and right upper side portions to the inclined rear side.

The banknote handover section 110 accordingly enables the collection space SC to be opened up widely at the left and right upper sides as well as at the inclined upper side, enabling a marked increase in visibility of the banknotes BL inside the collection space SC from the diagonal top left and right, these being the vantage points of the user.

In this state, in the banknote handover section 110 the biasing force of the spring 143 biases the second shutter 141 toward the closing direction S2; however, when an external force stronger than the biasing force of the of the spring 143 is applied toward the downward inclined direction, for example by the finger of a user, the second shutter 141 turns toward the opening direction S1, to achieve the second open state in which the end portion 141X is directed to the inclined lower side.

This thereby enables the banknote handover section 110 to enlarge the opening range of the collection space SC at the inclined upper side to the same extent as in the first exemplary embodiment, thereby enabling smooth insertion and removal of the user's fingertips to and from the collection space SC during banknote BL insertion and removal, and also enabling the banknotes BL in the collection space SC to be gripped easily.

In other words, in the banknote handover section 110, the shutter 22 of the first exemplary embodiment is divided into two in the front-rear inclined direction into the shutter 122 and the second shutter 141, each of which turns about a different turn shaft.

Accordingly, in the banknote handover section 110, the visibility of the banknotes BL in the open state can be raised to a similar degree, a similar degree of ease of operation when inserting and removing banknotes BL can be secured, and the surrounding space that has to be kept clear can be reduced.

In other respects, the banknote handover section 110 enables similar operation and effects to the banknote handover section 10 of the first exemplary embodiment.

According to the above configuration, in the banknote handover section 110 of the second exemplary embodiment, the frame 121 is cut away at the inclined upper side, an upper portion of the inclined rear side, and approximately the upper halves of the left and right side faces of the collection space SC, and these portions are covered by the shutter 122 and the second shutter 141. In the banknote handover section 110, the shutter 122 is turned with respect to the frame 121 by the turn shaft 23 at the inclined rear side, and the second shutter 141 is turned with respect to the frame 121 by the turn shaft 142 at the inclined front side. Accordingly, in the banknote handover section 110, the collection space SC is isolated from its surroundings when shutter 122 is in the closed state and the second shutter 141 is in the second closed state, and the inclined upper side and most of the left and right upper sides are opened up when the shutter 122 is in the open state, increasing the visibility of the collection space SC, and enabling increased ease of operation in removing the banknotes BL by allowing the user to turn the second shutter 141 to the second open state.

3. Third Exemplary Embodiment

Figure 9:
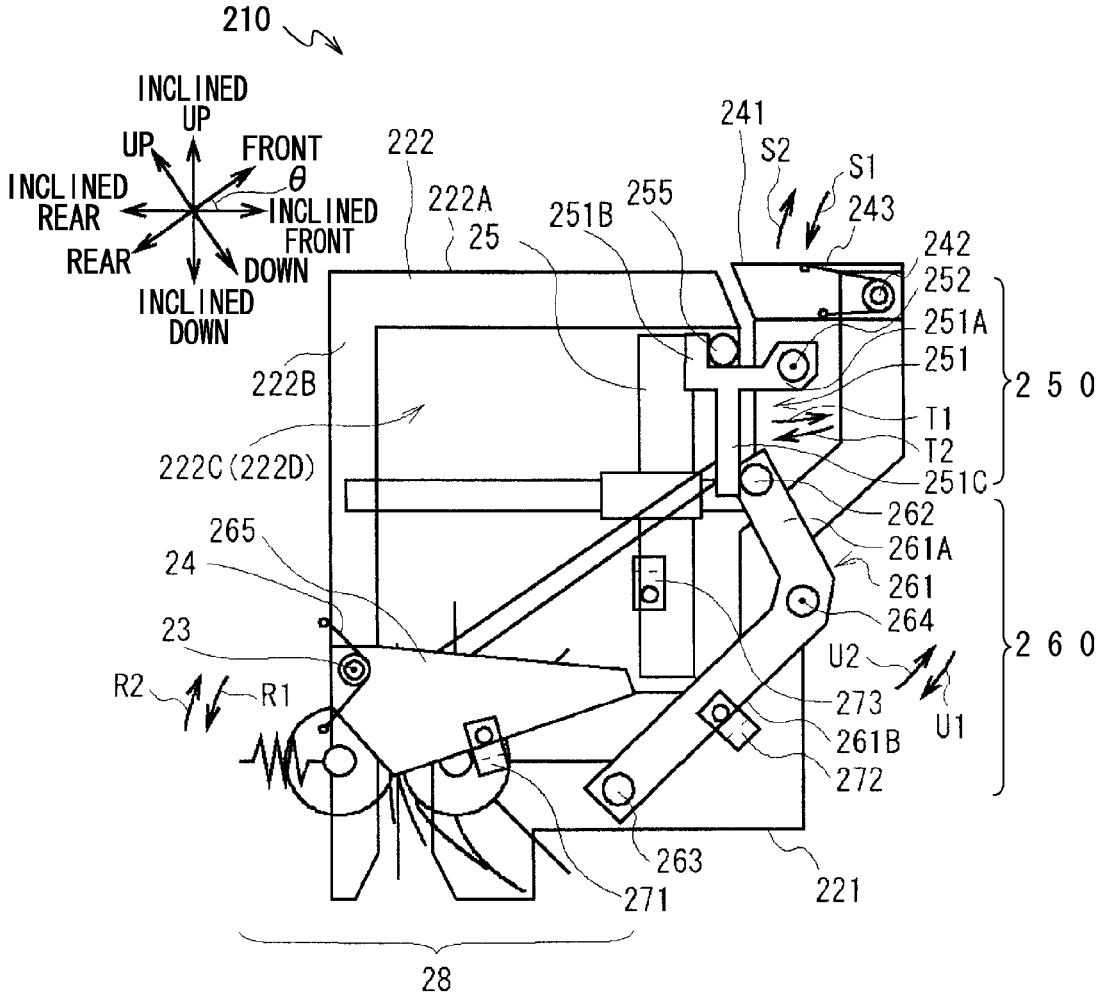
FIG. 9 is a schematic view illustrating a configuration of a banknote handover section according to a third exemplary embodiment.

In the third exemplary embodiment, as illustrated in FIG. 9, corresponding to FIG. 4A and FIG. 8, a banknote handover section 210 is employed, in the place of the banknote handover section 10, as the pay-out section 4 of the banknote processing device 1.

3-1. Banknote Handover Section Configuration

The banknote handover section 210 differs from the banknote handover section 10 of the first exemplary embodiment in that a frame 221 and a shutter 222 are provided in place of the frame 21 and the shutter 22, and that a second shutter 241, a turn shaft 242, a spring 243, a lock mechanism 250, and a link mechanism 260 are added. Other portions are configured similarly to the banknote handover section 10 of the first exemplary embodiment.

The frame 221, the second shutter 241, the turn shaft 242, and the spring 243 respectively have substantially the same configuration as the frame 121, the second shutter 141, the turn shaft 142, and the spring 143 of the second exemplary embodiment.

The shutter 222 is configured in substantially the same shape as the shutter 122 of the second exemplary embodiment, and an upper portion 222A, a rear portion 222B, a left side portion 222C, and a right side portion 222D cover an upper portion of the collection space SC.

The shutter 222 is attached to the frame 221 through a turn shaft 23 so as to be capable of turning, and is placed in an open state by turning in the opening direction R1, and placed in a closed state by turning in the closing direction R2, similarly to the shutter 122.

Note that in the third exemplary embodiment, in contrast to the second exemplary embodiment, drive force is not transmitted to the turn shaft 23 from an actuator or the like. Namely, the shutter 222 is biased toward the closing direction R2 with a relatively weak force by the action of the spring 24.

The shutter 222 is also provided with a locking post 255 and a cam plate 265. The locking post 255 is formed in a small, short, circular column shape, and is provided with the axial center thereof along the left-right direction in the vicinity of an inclined front end portion of an inner face of the left side portion 222C.

The cam plate 265 is formed in an overall triangular plate shape, with the plate faces facing the left-right direction. The cam plate 265 is attached to the left side portion 22C in the vicinity of an inclined lower end portion thereof, namely in the vicinity of the turn shaft 23, with its length direction running along the front-rear inclined direction.

The lock mechanism 250, serving as an engagement section, is configured by a locking lever 251, a turn shaft 252, and the locking post 255 mentioned above.

The locking lever 251 is a plate shaped member that is thin in the left-right direction, and is formed in a T-shape or a Y-shape as viewed along the left-right direction. The locking lever 251 is mainly configured by a long, thin base 251A with length direction running in the front-rear inclined direction.

A short locking arm 251B extends in the upward inclined direction at an inclined rear end portion of the base 251A. A comparatively long link arm 251C extends toward the inclined lower side at a location offset slightly toward the inclined rear side from the front-rear inclined direction center of the base 251A.

The locking lever 251 is supported on the frame 221 at an inclined front end portion of the base 251A, so as to be capable of being turned about the turn shaft 252.

The locking lever 251 is accordingly capable of turning freely with respect to the frame 221 in a release direction T1 that is the counterclockwise direction as viewed from the left side, and in a locking direction T2 that is the opposite direction thereto.

The locking lever 251 is biased toward the release direction T1 by a spring, not illustrated in the drawings.

As illustrated in FIG. 9, in the lock mechanism 250, the locking arm 251B is positioned to the inclined rear side of the locking post 255 in a state in which the shutter 222 is in the closed state and the base 251A faces substantially toward the rear inclined direction from the turn shaft 252.

In this state, the locking arm 251B of the locking lever 251 restricts movement of the locking post 255 toward the inclined rear side and the upper side, thereby restricting the shutter 222 from turning about the turn shaft 23 toward the opening direction R1. In the following, the state in which the locking arm 251B of the locking lever 251 is positioned at the inclined rear side of the locking post 255 in this manner is referred to as the locked state.

Figure 10:
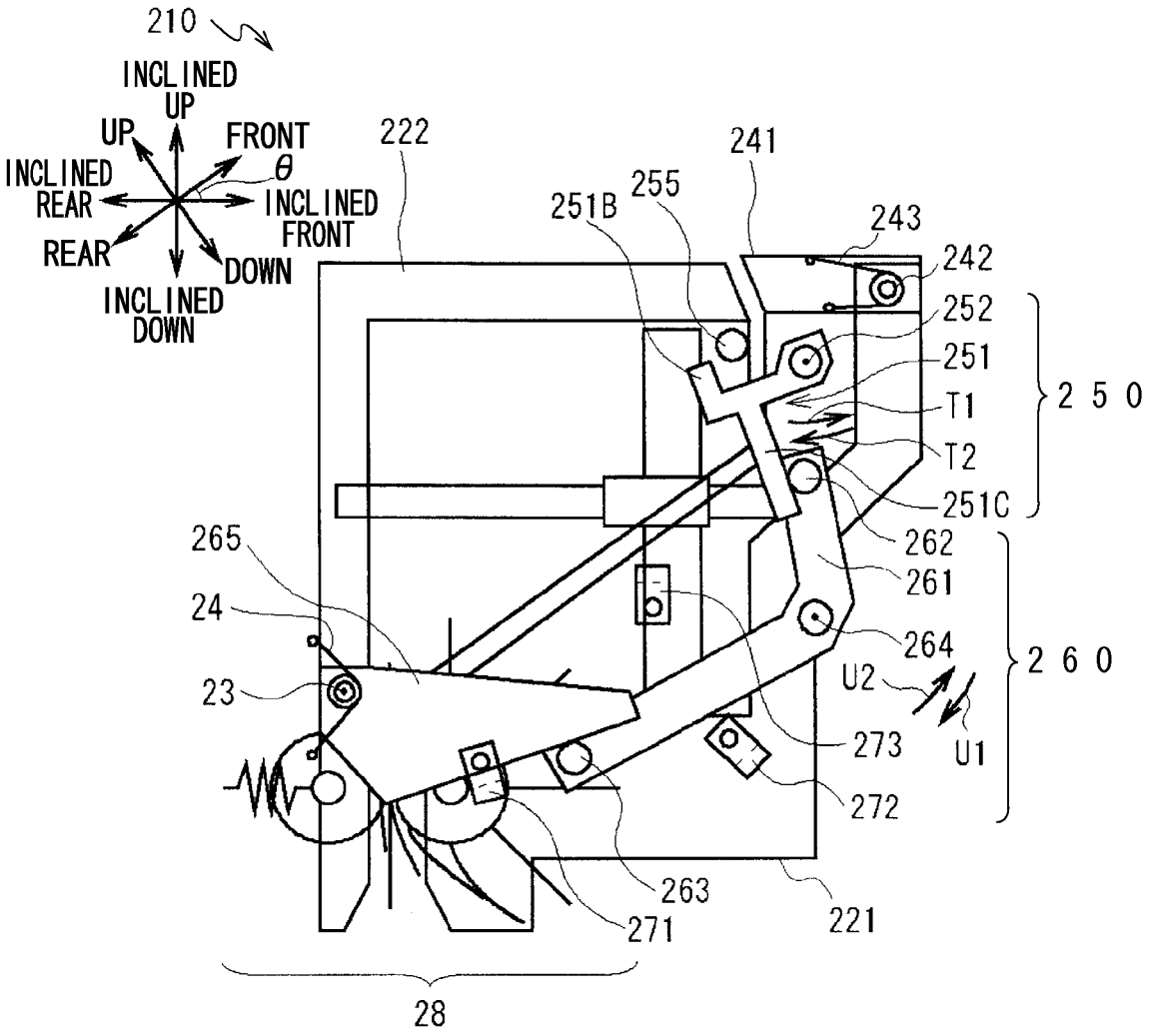
FIG. 10 is a schematic view illustrating a lock released state in the third exemplary embodiment.

In the lock mechanism 250, as illustrated in FIG. 10 corresponding to FIG. 9, when the locking lever 251 is turned toward the lock release direction T1 from the locked state, the locking arm 251B is retracted from the inclined rear side of the locking post 255.

In this state, the locking lever 251 no longer restricts movement of the locking post 255 toward the inclined rear side and the upper side, thereby permitting the shutter 222 to turn about the turn shaft 23 toward the opening direction R1. The state in which the locking arm 251B of the locking lever 251 has been retracted from the inclined rear side of the locking post 255 in this manner is referred to below as the lock released state.

In this manner, the lock mechanism 250 transitions between the locked state and the lock released state due to the locking lever 251 turning in either the lock release direction T1 or the locking direction T2.

The link mechanism 260 (FIG. 9) serving as an engagement coupling section is configured by a link lever 261, link posts 262 and 263, a turn shaft 264, and the cam plate 265 mentioned above.

The link lever 261 is a plate shaped member that is thin in the left-right direction, and is broadly divided into a first arm 261A and a second arm 261B, each of which is formed in a long, thin, rectangular shape.

The length direction of the first arm 261A runs substantially in the up-down direction. The small, circular column shaped link post 262 is provided at an upper end portion of the first arm 261A, with its axial center projecting along the left-right direction. A circumferential face of the link post 262 at the inclined rear side abuts an inclined front face of the link arm 251C of the locking lever 251.

The length direction of the second arm 261B runs substantially in the front-rear direction. The small, circular column shaped link post 263 is provided at a rear end portion of the second arm 261B, with its axial center projecting along the left-right direction.

In the link lever 261, a lower end portion of the first arm 261A is coupled together with a front end portion of the second arm 261B, configuring a shape in which the respective length directions of the two components intersect at an angle from approximately 90° to approximately 120°, namely in a substantially L-shape.

The link lever 261 is supported by the turn shaft 264 at the coupling portion between the first arm 261A and the second arm 261B so as to be capable of turning with respect to the frame 221.

The link lever 261 is thereby configured to turn freely with respect to the frame 221 in a link opening direction U1, this being the clockwise direction as viewed from the left, and in a link closing direction U2, this being the opposite direction thereto, when drive force is transmitted from an actuator, not illustrated in the drawings.

As illustrated in FIG. 9, in the link mechanism 260, the link post 262 abuts the link arm 251C of the locking lever 251 in the locked state.

In this state, the link post 262 restricts turning of the locking lever 251 that is biased toward the lock release direction T1 by a spring, not illustrated in the drawings, thereby holding the lock mechanism 250 in the locked state. The link post 263 does not abut any other components. This state of the link mechanism is referred to below as the link closed state.

In the link mechanism 260, when the link lever 261 is turned from the link closed state toward the link opening direction U1, the link post 263 eventually abuts a lower edge of the cam plate 265 as illustrated in FIG. 10.

When this occurs, the link post 262 moves further toward the front direction and front inclined direction than in the link closed state. Accompanying this, the locking lever 251 turns toward the lock release direction T1 with the link arm 251C abutting the link post 262 due to the biasing force of the spring, not illustrated in the drawings, to attain the lock released state. The shutter 222 is accordingly placed in a state capable of turning about the turn shaft 23 toward the opening direction R1.

Figure 11:
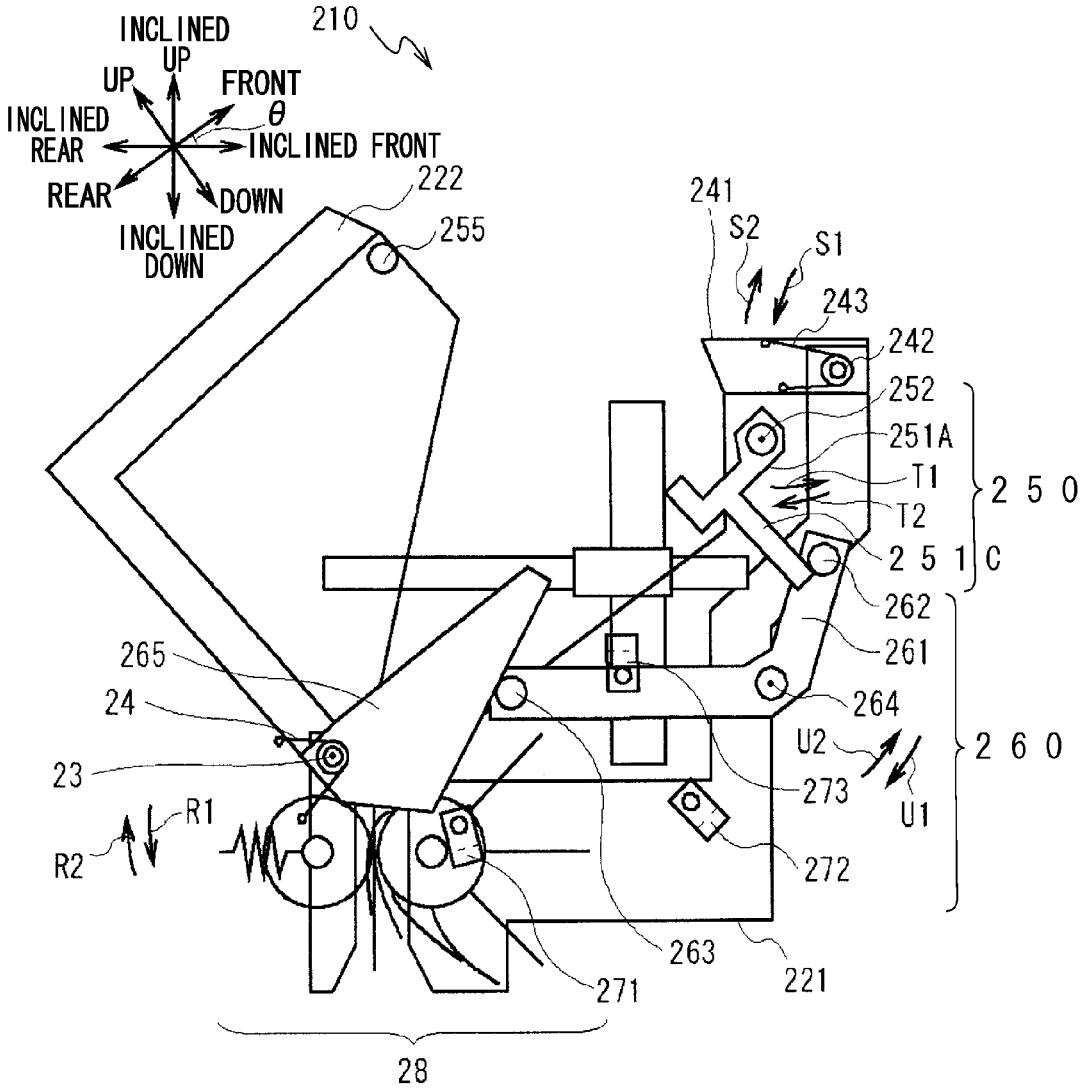
FIG. 11 is a schematic view illustrating an open state of a shutter in the third exemplary embodiment.

In the link mechanism 260, when the link lever 261 turns from the state illustrated in FIG. 10 further toward the link opening direction U1, the shutter 222 gradually turns in the opening direction R1 with the link post 263 imparting an upward force to the lower edge of the cam plate 265, until the shutter 222 is eventually placed in the open state, as illustrated in FIG. 11.

The link post 262 moves further toward the front direction and the front inclined direction accompanying turning of the link lever 261 toward the link opening direction U1. When this occurs, the locking lever 251 is turned further toward the lock release direction T1 with the link arm 251C abutting the link post 262.

The state of the link mechanism 260 when the link lever 261 has turned toward the link opening direction U1 and the shutter 222 has been placed in the open state in this manner is referred to below as the link opened state.

The link mechanism 260 transitions between the link opened state and the link closed state in this manner by turning the link lever 261 in the link opening direction U1 and the link closing direction U2.

In addition to this configuration, the banknote handover section 210 is also provided with a shutter detection sensor 271, a link closed detection sensor 272, and a link open detection sensor 273.

The shutter detection sensor 271 is configured by a light emitting portion that is disposed on the left side of the cam plate 265, and that emits a specific detection light, and a light receiving portion that is disposed on the right side of the cam plate 265 and receives the detection light, and outputs a detection signal indicating a light reception result to the controller 7 (FIG. 2).

The shutter detection sensor 271 is attached to the frame 221 at a position where the detection light is illuminated in the vicinity of the lower end of the cam plate 265 when the shutter 222 is in the closed state.

Accordingly, when the shutter 222 is in the closed state (FIG. 9), the detection light of the shutter detection sensor 271 is blocked by the cam plate 265 and so the detection light is not received by the light receiving portion. When the shutter 222 turns even slightly from the closed state (FIG. 10, FIG. 11) toward the opening direction R1, the detection light of the shutter detection sensor 271 is no longer blocked by the cam plate 265, and the detection light is received by the light receiving portion.

This thereby enables the controller 7 to recognize whether or not the shutter 222 is in the closed state, based on the detection signal from the shutter detection sensor 271.

The link closed detection sensor 272 is configured similarly to the shutter detection sensor 271. However, the link closed detection sensor 272 is attached at a position where the detection light is illuminated in the vicinity of the lower end of the second arm 261B when the link lever 261 is in the link closed state.

Accordingly, when the link lever 261 is in the link closed state (FIG. 9), the detection light of the link closed detection sensor 272 is blocked by the second arm 261B, and the detection light is not received by the light receiving portion. However, when the link lever 261 turns even slightly from the link closed state toward the link opening direction U1, the detection light of the link closed detection sensor 272 is no longer blocked by the second arm 261B, and the detection light is received by the light receiving portion.

This thereby enables the controller 7 to recognize whether or not the link mechanism 260 is in the link closed state, based on the detection signal from the link closed detection sensor 272.

The link open detection sensor 273 is configured similarly to the shutter detection sensor 271. However, the link open detection sensor 273 is attached at a position where the detection light is illuminated in the vicinity of the upper end of the second arm 261B when the link lever 261 is in the link opened state.

Accordingly, when the link lever 261 is in the link opened state (FIG. 11), the detection light of the link open detection sensor 273 is blocked by the second arm 261B, and the detection light is not received by the light receiving portion. However, when the link lever 261 turns even slightly from the link opened state (FIG. 10) toward the link closing direction U2, the detection light of the link open detection sensor 273 is no longer blocked by the second arm 261B, and the detection light is received by the light receiving portion.

This thereby enables the controller 7 to recognize whether or not the link mechanism 260 is in the link opened state, based on the detection signal from the link open detection sensor 273.

In this manner, the banknote handover section 210, the shutter 222, the locking lever 251, and the link lever 261 are turned while force is applied across each of them, and the controller 7 is able to recognize the states of the shutter 222 and the link lever 261.

3-2. Opening and Closing Operation of the Banknote Handover Section

In the banknote handover section 210, when the shutter 222 transitions to the open state or the closed state, the link lever 261 is turned based on control by the controller 7 to turn the shutter 222.

Figure 12:
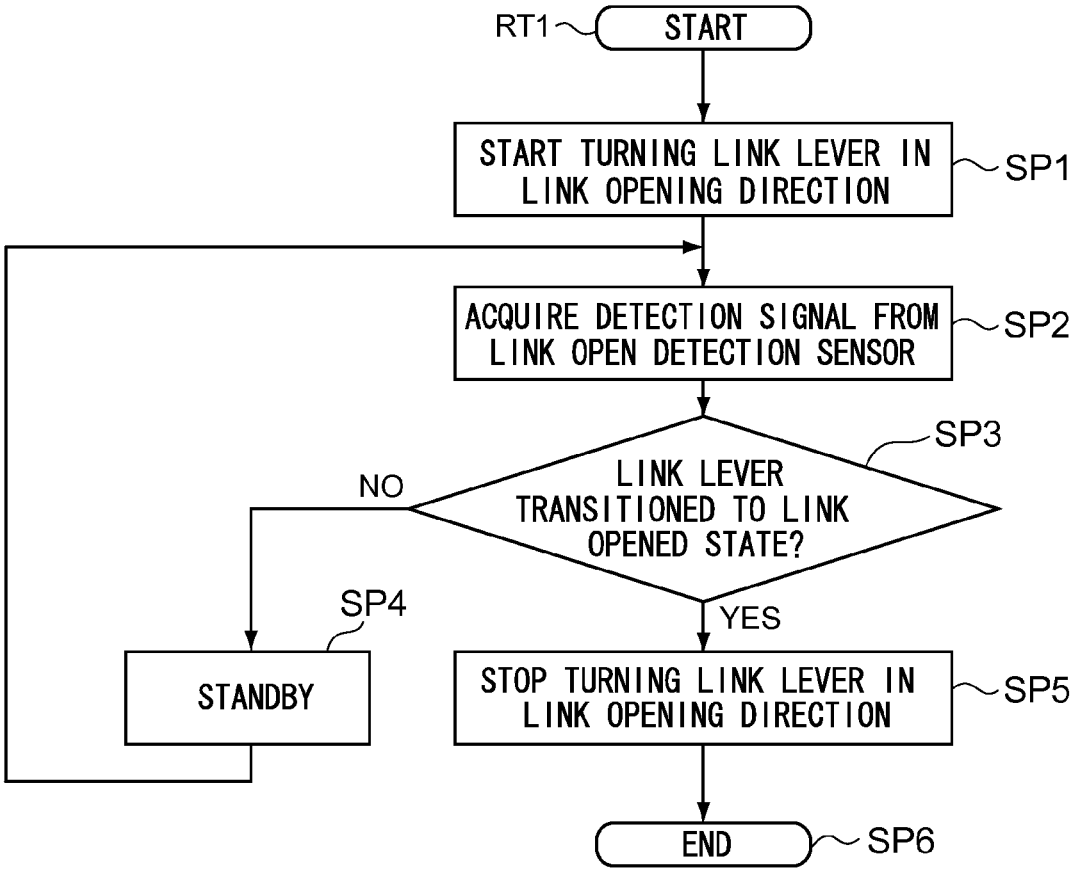
FIG. 12 is a flowchart illustrating a shutter opening processing routine.

The controller 7 executes processing of a shutter opening processing routine RT1, illustrated in FIG. 12, for example, during transition of the shutter 222 of the banknote handover section 210 from the closed state (FIG. 9) to the open state (FIG. 11).

Specifically, the controller 7 first begins the shutter opening processing routine RT1, and transitions to step SP1. At step SP1, the controller 7 drives an actuator, not illustrated in the drawings, to start turning the link lever 261 in the link opening direction U1, and transitions to the next step SP2.

The link lever 261 thus turns gradually toward the link opening direction U1, accompanying which the locking lever 251 is turned toward the lock release direction T1, eventually placing the locking lever 251 in the lock released state (FIG. 10).

Turning the link lever 261 further in the link opening direction U1 causes the link post 263 to abut the lower portion of the cam plate 265, after which the link post 263 turns the shutter 222 in the opening direction R1 through the cam plate 265.

At step SP2, the controller 7 acquires a detection signal from the link open detection sensor 273, and transitions to the next step SP3. At step SP3, the controller 7 determines whether or not the link lever 261 has transitioned to the link opened state based on the detection signal acquired from the link open detection sensor 273.

If a negative result is obtained at this point, this indicates that the link lever 261 has not yet transitioned to the link opened state, and therefore the shutter 222 has not transitioned to the open state. In such cases, the controller 7 transitions to the next step SP4 to continue turning the link lever 261.

At step SP4, the controller 7 adopts standby for a specific duration (for example 0.1 seconds), to allow the link lever 261 to turn further toward the link opening direction U1 and allow the shutter 222 to turn further in the opening direction R1, after which processing returns to step SP2 to wait for the transition to the link opened state.

However, if an affirmative result is obtained at step SP3, this indicates that the link lever 261 has completed its transition to the link opened state, and the shutter 222 has therefore also transitioned to the open state (FIG. 11). In such cases, the controller 7 transitions to the next step SP5.

At step SP5, the controller 7 stops driving the actuator, not illustrated in the drawings, thereby stopping the turning operation of the link lever 261, and transitions to the next step SP6 and ends the shutter opening processing routine RT1.

Figure 13:
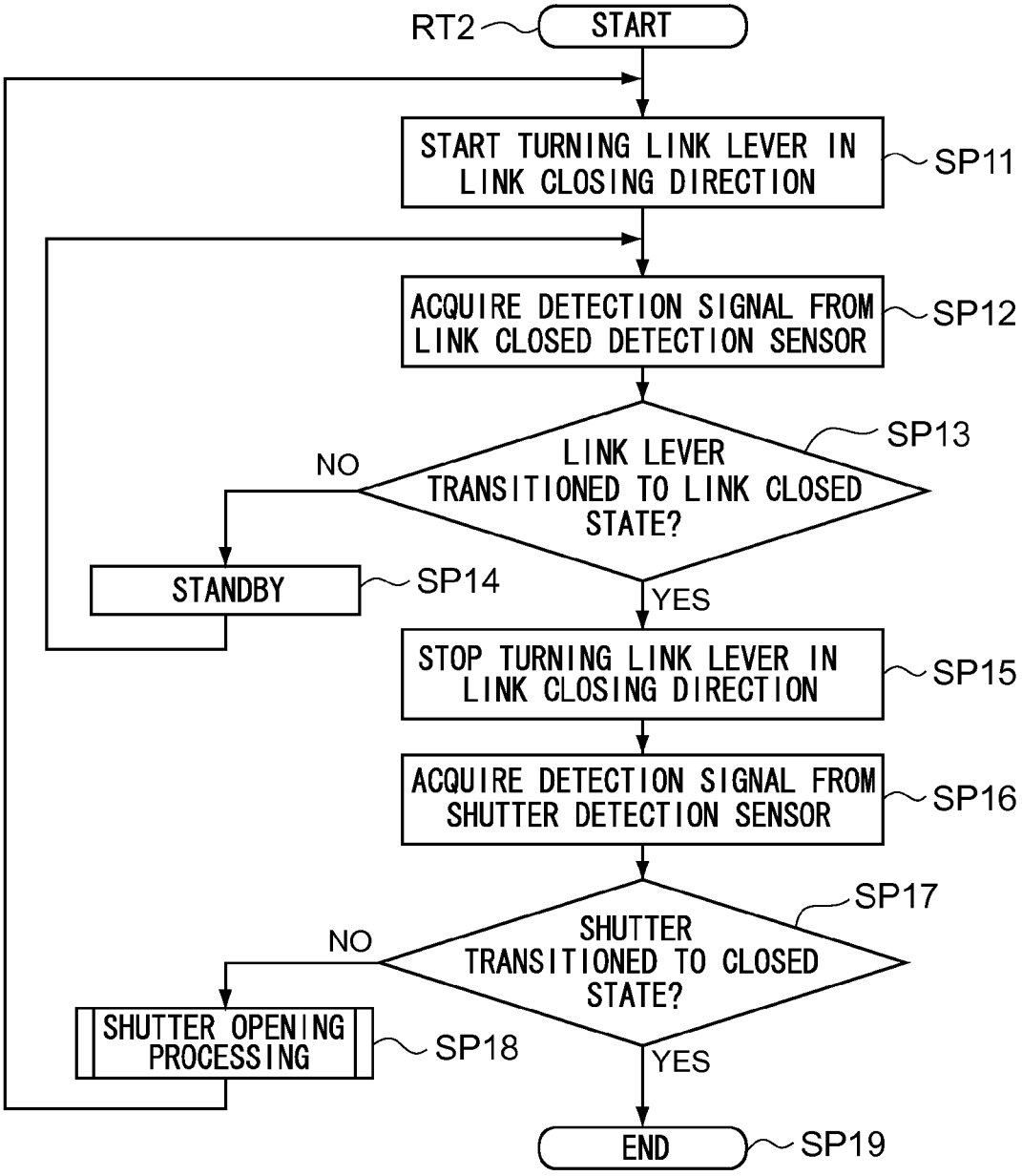
FIG. 13 is a flowchart illustrating a shutter closing processing routine.

The controller 7 executes processing of a shutter closing processing routine RT2, illustrated in FIG. 13, for example, during transition of the shutter 222 of the banknote handover section 210 from the open state (FIG. 11) to the closed state (FIG. 9).

Specifically, the controller 7 first begins the shutter closing processing routine RT2, and transitions to step SP11. At step SP11, the controller 7 drives the actuator, not illustrated in the drawings, to start turning the link lever 261 in the link closing direction U2, and transitions to the next step SP12.

The link lever 261 thus turns gradually toward the link closing direction U2, accompanying which the action of the spring 24 turns the cam plate 265 and the shutter 222 toward the closing direction R2, eventually reaching the closed state (FIG. 10).

When the link lever 261 turns further in the link closing direction U2, the link post 262 is moved in the rear inclined direction, accompanying which the locking lever 251 is turned in the locking direction T2, eventually placing the locking lever 251 in the locked state (FIG. 9).

At step SP12, the controller 7 acquires a detection signal from the link closed detection sensor 272, and transitions to the next step SP13. At step SP13, the controller 7 determines whether or not the link lever 261 has transitioned to the link closed state based on the detection signal acquired from the link closed detection sensor 272.

If a negative result is obtained at this point, this indicates that the link lever 261 has not yet transitioned to the link closed state, and therefore the shutter 222 has not transitioned to the closed state. In such cases, the controller 7 transitions to the next step SP14 to continue turning the link lever 261.

At step SP14, the controller 7 adopts standby for a specific duration (for example 0.1 seconds) to allow the link lever 261 to turn further toward the link closing direction U2 and allow the shutter 222 to turn further toward the closing direction R2, after which processing returns to step SP12 to wait for the transition to the link closed state.

However, if an affirmative result is obtained at step SP13, this indicates that the link lever 261 has completed its transition to the link closed state. In such cases, the controller 7 transitions to the next step SP15.

At step SP15, the controller 7 stops driving the actuator, not illustrated in the drawings, thereby stopping the turning operation of the link lever 261, and transitions to the next step SP16.

At step SP16, the controller 7 acquires a detection signal from the shutter detection sensor 271, and transitions to the next step SP17. At step SP17, the controller 7 determines whether or not the shutter 222 has transitioned to the closed state based on the detection signal acquired from the shutter detection sensor 271.

Figure 14:
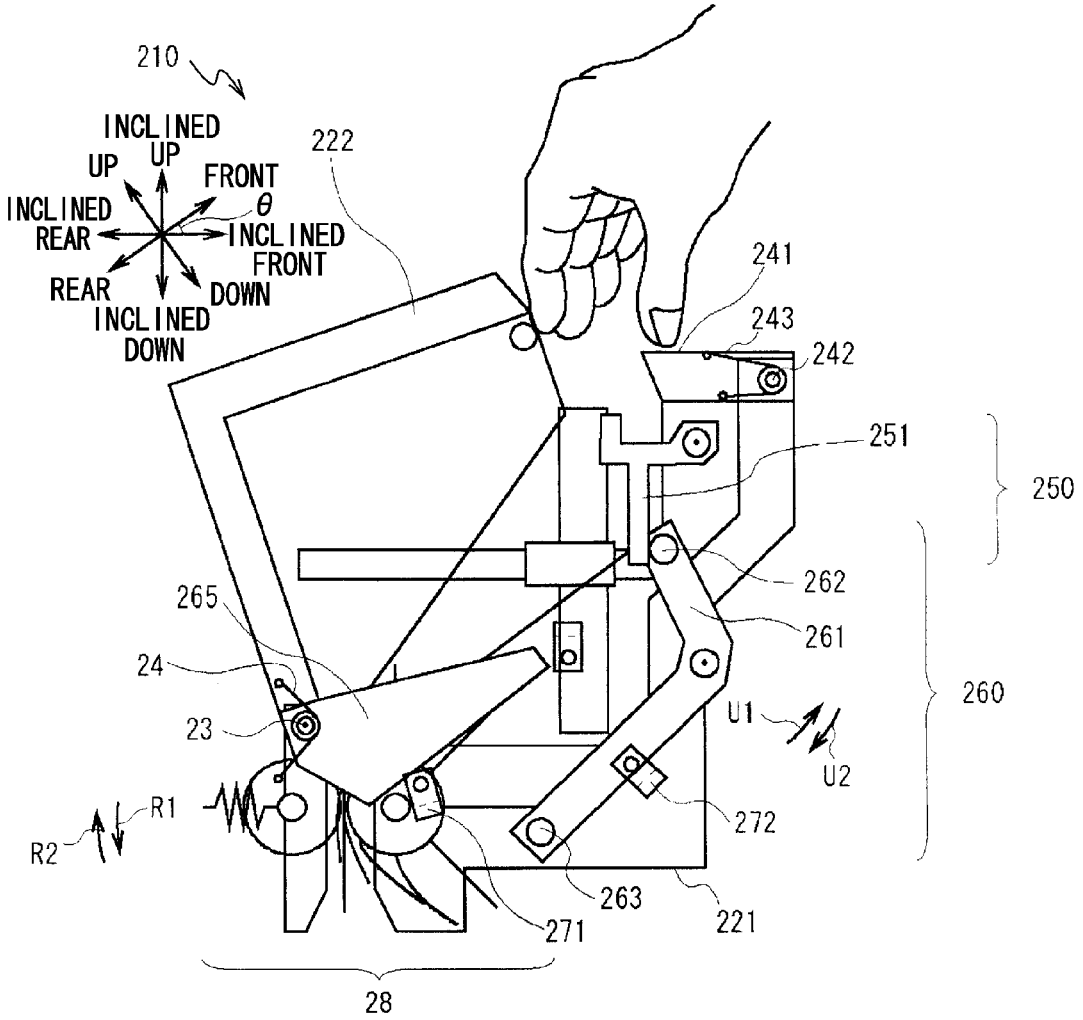
FIG. 14 is a schematic view illustrating a state in which a shutter of the third exemplary embodiment is prevented from closing.
Figure 15:
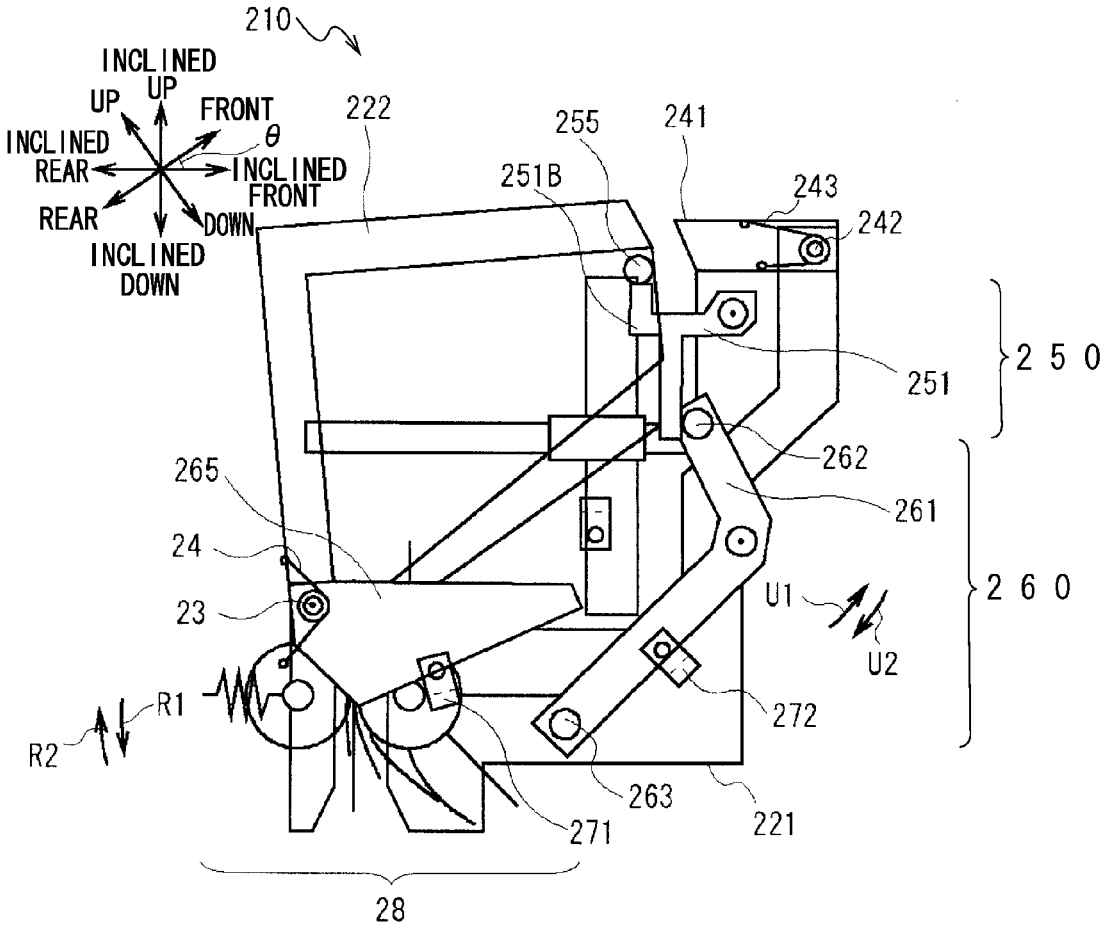
FIG. 15 is a schematic view illustrating a state in which a shutter of the third exemplary embodiment is prevented from closing.

A negative result obtained at this point indicates, for example, as illustrated in FIG. 14, that the turning operation of the shutter 222 has been interrupted due to contacting the hand of the user or the like when turning in the closing direction R2, and has not been able to transition to the closed state. Alternatively, it indicates that, even supposing the hand of the user or the like has been moved after coming into contact, and the shutter 222 has turned in the closing direction R2 under the action of the spring 24, the shutter 222 has not been able to transition to the closed state due to the locking post 255 impinging on the locking lever 251 that is already in the locked state, as illustrated in FIG. 15. In such cases, the controller 7 transitions to the next step SP18.

At step SP18, the controller 7 executes processing similar to that of the shutter opening processing routine RT1 described above (FIG. 12), thereby returning the link lever 261 to the link opened state and returning the shutter 222 to the open state, before returning to step SP11 and repeating the processing sequence.

However, if an affirmative result is obtained at step SP17, this indicates that the shutter 222 has transitioned to the closed state, and that the locking lever 251 is in the locked state since the link lever 261 is in the link closed state, and that the locking arm 251B is positioned to the inclined rear side of the locking post 255 to restrict turning of the shutter 222 (FIG. 9). In such cases, the controller 7 transitions to the next step SP19 and ends the shutter closing processing routine RT2.

The banknote handover section 210 accordingly opens and closes the shutter 222 by turning the link lever 261 based on control by the controller 7, and in particular, when it has been detected that the shutter 222 has not been able to close correctly, the shutter 222 is opened once again and then re-closed.

3-3. Operation and Effects

In the banknote handover section 210 according to the third exemplary embodiment configured as described above, the collection space SC is isolated from the outside (FIG. 9) when the shutter 222 is in the closed state, the locking lever 251 is in the locked state, and the link lever 261 is in the link closed state (this is referred to below as the closed and locked state).

In this state of the banknote handover section 210, similarly to the first exemplary embodiment and the second exemplary embodiment, noise accompanying the operation of each section of the discharge section 28, and of conveyance of the banknotes BL, can be blocked, and safety can be secured by preventing the fingers of the user, for example, from contacting the moving stage 25 or the like.

In particular, in the locked state, the locking lever 251 retains the shutter 222 in the closed state through the locking post 255. This thereby enables the shutter 222 to be maintained in the closed state such that it does not turn, even when applied with external force acting in the opening direction R1, thereby forestalling the risk of unintentionally opening the shutter 222 for example during operation of the discharge section 28 or the stage 25, and causing injury to the finger of a user or the like.

In the above state of the banknote handover section 210, similarly to the second exemplary embodiment, the second shutter 241 is restricted from turning by the shutter 222, enabling the second shutter 241 to be held in the second closed state.

In the banknote handover section 210, when the link lever 261 turns from the closed and locked state toward the link opening direction U1, the locking lever 251 turns toward the lock release direction T1 accompanying the movement of the link post 262 toward the front inclined direction, eventually reaching the lock released state (FIG. 10).

Accompanying this, the link lever 261 moves the link post 263 upward to abut the lower portion of the cam plate 265, thereby applying an upward force to the shutter 222 through the cam plate 265. The shutter 222 is accordingly turned in the opening direction R1, eventually reaching the open state (FIG. 11).

Similarly to the first exemplary embodiment and the second exemplary embodiment, the banknote handover section 210 thereby enables the collection space SC of the banknote handover section 210 to be opened up widely at the left and right upper sides as well as at the inclined upper side, enabling a marked increase in the visibility of the banknotes BL inside the collection space SC from the diagonal top left and right, these being the vantage points of the user.

Moreover, similarly to the second exemplary embodiment, in the banknote handover section 210, when an external force stronger than the biasing force of the spring 243 is applied toward the downward inclined direction, for example by the finger of a user, during the open state of the shutter 222, the second shutter 241 turns toward the opening direction S1 to attain the second open state.

This thereby enables the banknote handover section 210 to enlarge the opening range of the collection space SC at the inclined upper side to the same extent as in the first exemplary embodiment, thereby enabling smooth insertion and removal of the user's fingertips in and out of the collection space SC during banknote BL insertion and removal, and also enabling the banknotes BL in the collection space SC to be gripped easily.

The banknote handover section 210 enables a locking operation and lock release operation of the shutter 222 by the locking lever 251, and a turning operation of the shutter 222 through the cam plate 265, to be performed simply by turning the link lever 261 of the link mechanism 260. This thereby eliminates the need to provide separate actuators for each operation, enabling simpler configuration.

In the banknote handover section 210, the link post 263 and the cam plate 265 are held away from one another (FIG. 9) when the link lever 261 is in the link closed state and the locking lever 251 is in the locked state. The link post 263 abuts the cam plate 265 when the locking lever 251 has transitioned from the locked state to the lock released state.

Therefore, in the banknote handover section 210, simply by turning the link lever 261 continuously in the link opening direction U1 or the link closing direction U2, the locking operation or lock release operation of the shutter 222, and the turn operation of the shutter 222 through the cam plate 265 can be performed in sequence at an appropriate timing with a time lag introduced therebetween.

In the banknote handover section 210, during the closing operation of the shutter 222, rather than pulling the cam plate 265 downward using the link post 263, the biasing force of the spring 24 toward the closing direction R2 is employed to move the link post 263 downward as the link lever 261 turns in the link closing direction U2.

Accordingly, in the banknote handover section 210, even supposing the fingers of the user were to contact the shutter 222 as it turned in the closing direction R2, the link post 263 would separate from the cam plate 265, enabling the relatively strong drive force applied to the link lever 261 to be disconnected from the shutter 222, and imparting only the relatively weak force of the spring 24.

Namely, the banknote handover section 210 enables preventing incidents in which, for example, a finger of user is injured due to becoming caught between the shutter 222 and the second shutter 241 during the closing operation of the shutter 222.

In the banknote handover section 210, similarly to the second exemplary embodiment, and in contrast to the first exemplary embodiment, the shutter 22 of the first exemplary embodiment is divided into two in the front-rear inclined direction into the shutter 222 and the second shutter 241, each of which turns about a different turn shaft.

Accordingly, similarly to the second exemplary embodiment, in the banknote handover section 210, the visibility of the banknotes BL in the open state can be raised to a similar degree, a similar degree of ease of operation when inserting and removing banknotes BL can be secured, and the surrounding space that has to be kept clear can be reduced.

The banknote handover section 210 independently detects and notifies the controller 7 as to whether or not the shutter 222 is in the closed state, and whether or not the link mechanism 260 is in the link closed state, using the shutter detection sensor 271 and the link closed detection sensor 272.

This thereby enables reliable transition to the closed state, due to the controller 7 repeating the closing operation of the shutter 222 when the shutter 222 has not closed (FIG. 14, FIG. 15) even after the link lever 261 has finished turning in the link closing direction U2.

The banknote handover section 210 moreover enables similar operation and effects to the banknote handover section 10 of the first exemplary embodiment in other respects.

According to the above configuration, in the banknote handover section 210 of the third exemplary embodiment, the shutter 222 and the second shutter 241 cover the inclined upper side, the upper portion of the inclined rear side, and approximately the upper halves of the left and right side faces of the collection space SC of the frame 221, and the shutter 222 and the second shutter 241 respectively turn about the turn shaft 23 and the turn shaft 242. Moreover, in the banknote handover section 210, the locking lever 251 is turned to switch between the locked state and the lock released state, and the shutter 222 is turned through the cam plate 265, coupled with the turning of the link lever 261. In the banknote handover section 210, the shutters can accordingly isolate the collection space SC from its surroundings when the shutter 222 is in the closed state and the lock mechanism 250 is in the locked state, and when the second shutter 241 is in the second closed state. The banknote handover section 210 moreover enables the shutter 222 to be placed in the lock released state before being placed in the open state by simply turning the link lever 261 in the link opening direction U1, enables the visibility of the collection space SC to be increased, and enables increased ease of operation when the user turns the second shutter 241 to the second open state and removes the banknotes BL.

4. Fourth Exemplary Embodiment

Figure 16:
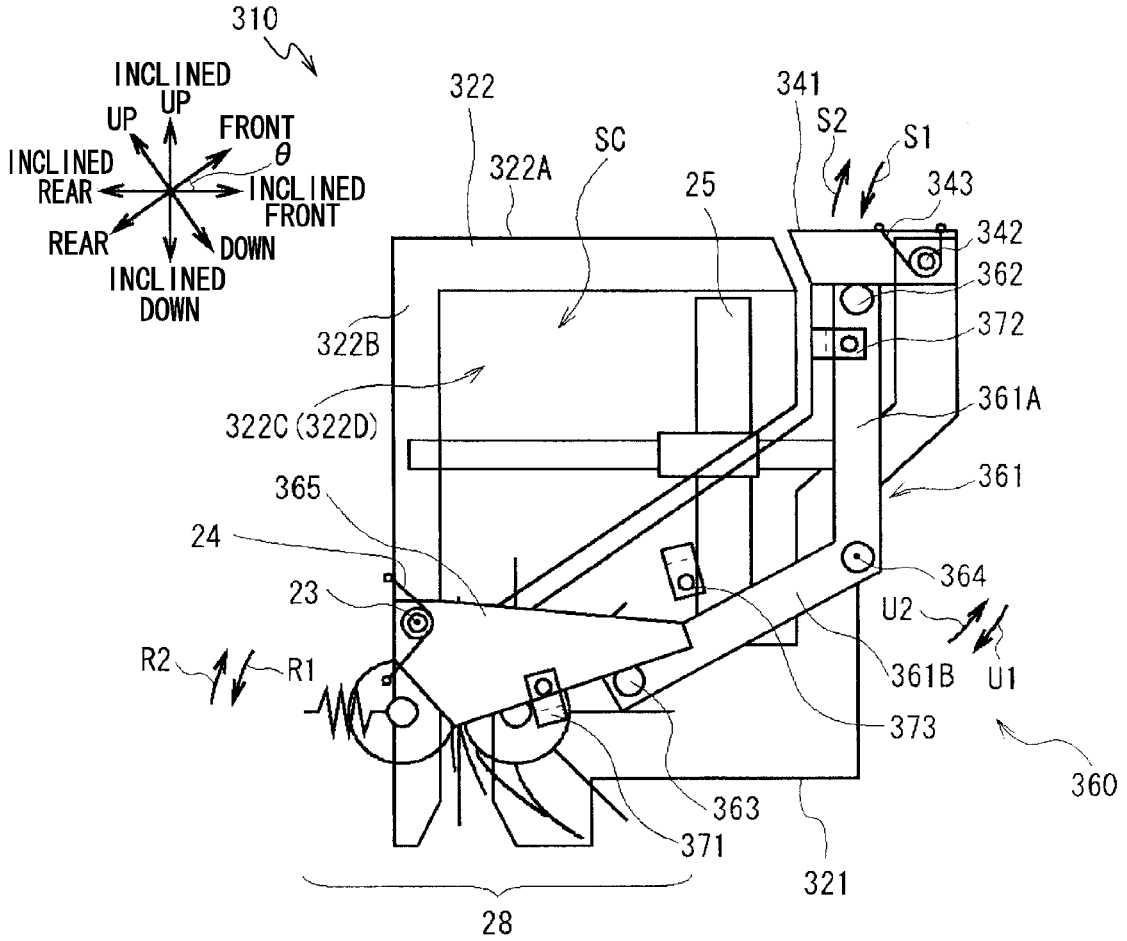
FIG. 16 is a schematic view illustrating a configuration of a banknote handover section according to a fourth exemplary embodiment.

In the fourth exemplary embodiment, as illustrated in FIG. 16, corresponding to FIG. 4A, FIG. 8, and FIG. 9, a banknote handover section 310 is employed, in the place of the banknote handover section 10, as the pay-out section 4 of the banknote processing device 1.

4-1. Banknote Handover Section Configuration

The banknote handover section 310 differs from the banknote handover section 10 of the first exemplary embodiment in that a frame 321 and a shutter 322 are provided in place of the frame 21 and the shutter 22, and that a second shutter 341, a turn shaft 342, a spring 343, and a link mechanism 360 are added. Other portions are configured similarly to the banknote handover section 10 of the first exemplary embodiment.

The frame 321, the second shutter 341, and the turn shaft 342 respectively have substantially the same configuration as the frame 121, the second shutter 141, and the turn shaft 142 of the second exemplary embodiment.

The shutter 322 is configured with substantially the same shape as the shutter 122 of the second exemplary embodiment (FIG. 8), and an upper portion 322A, a rear portion 322B, a left side portion 322C, and a right side portion 322D cover an upper portion of the collection space SC.

The shutter 322 is attached to an inclined rear side of the frame 321 through a turn shaft 23 so as to be capable of turning, and is placed in an open state by turning in the opening direction R1, and placed in a closed state by turning in the closing direction R2, similarly to the shutter 122.

Note that in the fourth exemplary embodiment, similarly to the third exemplary embodiment (FIG. 9), drive force is not transmitted to the turn shaft 23 from an actuator or the like. Similarly to in the third exemplary embodiment, the shutter 322 is therefore biased in the closing direction R2 by the action of the spring 24, and is in the closed state when not specifically applied with external force.

A cam plate 365 corresponding to the cam plate 265 of the third exemplary embodiment is attached to the shutter 322. The cam plate 365 has a shape resembling that of the cam plate 265 of the third exemplary embodiment, having a triangular shape as viewed from the left and right side faces; however, the lengths of each side differ to those of the cam plate 265.

A spring 343 is provided in the vicinity of the turn shaft 342 that turns the second shutter 341. In contrast to the second and third exemplary embodiments, the spring 343 biases the second shutter 341 in the opening direction S1.

The link mechanism 360, serving as an opening and closing coupling section, is configured by a link lever 361, link posts 362 and 363, a turn shaft 364, and the cam plate 365 mentioned above.

Similarly to the link lever 261 (FIG. 9) of the third exemplary embodiment, the link lever 361 is mainly configured by a first arm 361A and a second arm 361B.

In contrast to the first arm 261A of the third exemplary embodiment, the length direction of the first arm 361A runs in the up-down inclined direction in the link closed state, and an upper end thereof reaches the vicinity of the second shutter 341.

The link post 362 is provided projecting out in a similar shape to the link post 262 of the third exemplary embodiment at the vicinity of the upper end of the first arm 361A. The link post 362 abuts a lower face of the second shutter 341 in the link closed state, thereby restricting turning of the second shutter 341 that is biased in the opening direction S1 by the spring 343, and holding the second shutter 341 in the second closed state.

Similarly to the second arm 261B of the third exemplary embodiment, the length direction of the second arm 361B runs substantially in the front-rear direction.

The link post 363 is provided projecting out in a similar shape to the link post 263 of the third exemplary embodiment in the vicinity of the rear end of the second arm 361B. In contrast to the third exemplary embodiment, the link post 363 contacts a lower edge of the cam plate 365 in the link closed state.

In the link lever 361, a lower end portion of the first arm 361A is coupled together with a front end portion of the second arm 361B, configuring a shape in which the respective length directions of the two components intersect at an angle approximately from 120° to 150°.

Similarly to the third exemplary embodiment, the link lever 361 is supported by the turn shaft 364 at the coupling portion between the first arm 361A and the second arm 361B, so as to be capable of turning with respect to the frame 321.

Similarly to the third exemplary embodiment, the link lever 361 accordingly turns in the link opening direction U1 or the link closing direction U2 with respect to the frame 321 when drive force is transmitted from an actuator, not illustrated in the drawings.

As illustrated in FIG. 16, in the banknote handover section 310, when the link mechanism 360 is in the link closed state, the action of the spring 24 places the shutter 322 in the closed state, and the second shutter 341 is placed in the second closed state due to the second shutter 341 being supported from the lower side by the link post 362.

In this state of the link mechanism 360, when the link lever 361 turns from the link closed state toward the link opening direction U1, an upward force is applied to the cam plate 365 from the link post 363, accompanying which the shutter 322 is turned in the opening direction R1 against the biasing force of the spring 24.

Moreover, in the link mechanism 360, the link post 362 is moved toward the front inclined direction and downward due to turning of the link lever 361 in the link opening direction U1, accompanying which the second shutter 341 is turned in the opening direction S1 by the action of the spring 343.

In the banknote handover section 310, the link lever 361 is then turned further in the link opening direction U1, thereby turning the shutter 322 further in the opening direction R1, and turning the second shutter 341 further in the opening direction S1.

Figure 17:
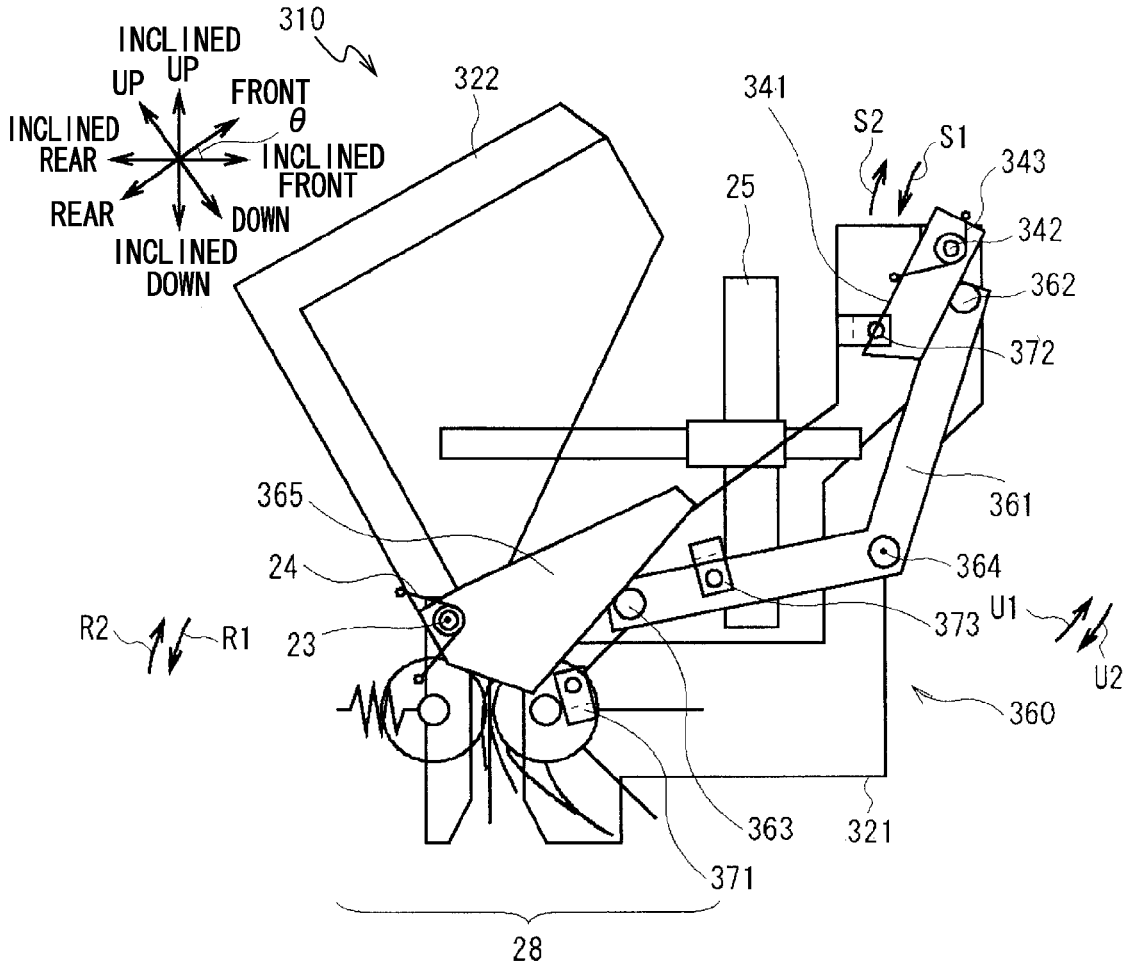
FIG. 17 is a schematic view illustrating an open state of a shutter according to the fourth exemplary embodiment.

As illustrated in FIG. 17, in the banknote handover section 310, the shutter 322 eventually transitions to the open state, and the second shutter 341 transitions to the second open state. When this occurs, the link mechanism 360 is in a link opened state.

The banknote handover section 310 is further provided with a shutter detection sensor 371, a link closed detection sensor 372, and a link open detection sensor 373. The shutter detection sensor 371, the link closed detection sensor 372, and the link open detection sensor 373 are each configured by a light emitting portion that emits detection light, and a light receiving portion that receives the detection light and generates a light reception signal, similarly to the shutter detection sensor 271 and so on in the third exemplary embodiment.

The shutter detection sensor 371 corresponds to the shutter detection sensor 271, and is attached to the frame 321 at a position where the detection light is illuminated in the vicinity of a lower end of the cam plate 365 when the shutter 322 is in the closed state.

Accordingly, when the shutter 322 is in the closed state (FIG. 16), the detection light of the shutter detection sensor 371 is blocked by the cam plate 365, and the detection light is not received by the light receiving portion. When the shutter 322 turns even slightly from the closed state toward the opening direction R1, the detection light of the shutter detection sensor 371 is no longer blocked by the cam plate 365, and the detection light is received by the light receiving portion.

This thereby enables the controller 7 to recognize whether or not the shutter 322 is in the closed state, based on the detection signal from the shutter detection sensor 371.

The link closed detection sensor 372 corresponds to the link closed detection sensor 272, and is attached at a position where the detection light is blocked by the first arm 361A when the link lever 361 is in the link opened state.

Accordingly, when the link lever 361 is in the link closed state (FIG. 16), the detection light of the link closed detection sensor 372 is blocked by the first arm 361A, and the detection light is not received by the light receiving portion. When the link lever 361 turns even slightly from the link closed state toward the link opening direction U1, the detection light of the link closed detection sensor 372 is no longer blocked by the first arm 361A, and the detection light is received by the light receiving portion.

This thereby enables the controller 7 to recognize whether or not the link mechanism 360 is in the link closed state, based on the detection signal from the link closed detection sensor 372.

The link open detection sensor 373 corresponds to the link open detection sensor 273, and is attached at a position where the detection light is illuminated in the vicinity of the upper end of the second arm 361B when the link lever 361 is in the link opened state.

Accordingly, when the link lever 361 is in the link opened state (FIG. 17), the detection light of the link open detection sensor 373 is blocked by the second arm 361B, and the detection light is not received by the light receiving portion. When the link lever 361 turns even slightly from the link opened state toward the link closing direction U2, the detection light of the link open detection sensor 373 is no longer blocked by the second arm 361B, and the detection light is received by the light receiving portion.

This thereby enables the controller 7 to recognize whether or not the link mechanism 360 is in the link opened state, based on the detection signal from the link open detection sensor 373.

In this manner, in the banknote handover section 310, the shutter 322, the second shutter 341, and the link lever 361 are turned while force is applied across each of them, and the controller 7 is able to recognize the states of the shutter 322 and the link lever 361.

Similarly to the banknote handover section 210 of the third exemplary embodiment, the banknote handover section 310 opens and closes the shutter 322 by following the shutter opening processing routine RT1 (FIG. 12) and the shutter closing processing routine RT2 (FIG. 13) based on control by the controller 7.

4-2. Operation and Effects

The banknote handover section 310 of the fourth exemplary embodiment configured as described above places the second shutter 341 in the second closed state, and isolates the collection space SC from the outside (FIG. 16), when the shutter 322 is in the closed state and the link lever 361 is in the link closed state.

In this state of the banknote handover section 310, similarly to the first exemplary embodiment and the second exemplary embodiment, noise accompanying the operation of each section of the discharge section 28, conveyance of the banknotes BL, and the like can be blocked, and safety can be secured by preventing the fingers of the user, for example, from contacting the moving stage 25 or the like.

In this state of the banknote handover section 310, similarly to the second exemplary embodiment, the shutter 322 restricts turning of the second shutter 341, enabling the second shutter 341 to be held in the second closed state.

In the banknote handover section 310, when the link lever 361 turns from the link closed state toward the link opening direction U1, upward force is applied to the shutter 322 through the cam plate 365 due to the upward movement of the link post 363, thereby turning the shutter 322 in the opening direction R1 and eventually placing the shutter 322 in the open state (FIG. 17).

Accompanying this, the link lever 361 turns the second shutter 341 in the opening direction S1 using the action of the spring 343, accompanying movement of the link post 362 toward the front inclined direction and downward, eventually placing the second shutter 341 in the second open state (FIG. 17).

Similarly to the first, second, and third exemplary embodiments, the banknote handover section 310 thus enables the collection space SC to be opened up widely at the left and right upper sides as well as at the inclined upper side, enabling a marked increase in the visibility of the banknotes BL inside the collection space SC from the diagonal top left and right, these being the vantage points of the user.

In contrast to the second and third exemplary embodiments, the banknote handover section 310 enables the second shutter 341 to be turned in the opening direction S1 and placed in the second open state accompanying turning of the link lever 361 in the link opening direction U1, without applying force from the fingers of the user or the like.

This thereby enables the banknote handover section 310 to automatically enlarge the opening range of the collection space SC at the inclined upper side to the same extent as in the first exemplary embodiment, thereby enabling smooth insertion and removal of the user's fingertips in and out of the collection space SC during insertion and removal of the banknotes BL, and also enabling the banknotes BL in the collection space SC to be gripped easily.

The banknote handover section 310 enables the turning operation of the shutter 322 through the cam plate 365, and the turning operation of the second shutter 341, to be coupled together simply by turning the link lever 361 of the link mechanism 360, thereby eliminating the need to provide separate actuators for the respective operations, enabling a simpler configuration.

Similarly to the third exemplary embodiment, during the closing operation of the shutter 322 of the banknote handover section 310, rather than pulling the cam plate 365 downward using the link post 363, the biasing force of the spring 24 toward the closing direction R2 is employed to move the link post 363 downward as the link lever 361 turns in the link closing direction U2.

Accordingly, similarly to the third exemplary embodiment, the banknote handover section 310 enables preventing incidents in which a finger of user is injured due to becoming caught between the shutter 322 and the second shutter 341 during the closing operation of the shutter 322.

In the banknote handover section 310, similarly to the second and third exemplary embodiments, and in contrast to the first exemplary embodiment, the shutter 32 of the first exemplary embodiment is divided into two in the front-rear inclined direction into the shutter 322 and the second shutter 341, each of which turns about a different turn shaft.

Accordingly, similarly to the second and third exemplary embodiments, in the banknote handover section 310, the visibility of the banknotes BL in the open state can be raised to a similar degree, a similar degree of ease of operation when inserting and removing banknotes BL can be secured, and the surrounding space that has to be kept clear can be reduced.

Similarly to the third exemplary embodiment, the banknote handover section 310 independently detects and notifies the controller 7 as to whether or not the shutter 322 is in the closed state, and whether or not the link mechanism 360 is in the link closed state, using the shutter detection sensor 371 and the link closed detection sensor 372.

Similarly to the third exemplary embodiment, this thereby enables reliable transition to the closed state due to the controller 7 repeating the closing operation of the shutter 322 when the shutter 322 has not closed for reasons such a foreign object becoming caught, even after the link lever 361 has finished turning in the link closing direction U2.

The banknote handover section 310 moreover enables similar operation and effects to the banknote handover section 10 of the first exemplary embodiment in other respects.

According to the above configuration, in the banknote handover section 310 of the fourth exemplary embodiment, the shutter 322 and the second shutter 341 cover the inclined upper side, the upper portion of the inclined rear side, and approximately the upper halves of the left and right side faces of the collection space SC of the frame 321, and the shutter 322 and the second shutter 341 are respectively turned by the turn shaft 23 and the turn shaft 342. Moreover, in the banknote handover section 310, turning of the shutter 322 through the cam plate 365, and movement of the contact location between the lower face of the second shutter 341 and the link post 362, are coupled to turning of the link lever 361. In the banknote handover section 310, the shutters can accordingly isolate the collection space SC from its surroundings when the shutter 322 is in the closed state and the second shutter 341 is in the second closed state. The banknote handover section 310 moreover enables the shutter 322 to be placed in the open state and the second shutter 341 to be placed in the second open state simply by turning the link lever 361 in the link opening direction U1, enables the visibility of the collection space SC to be increased, and enables increased ease of operation when removing the banknotes BL.

5. Other Exemplary Embodiments

In the first exemplary embodiment described above, explanation has been given regarding a case in which the collection space SC inside the frame 21 opens up in the rear inclined direction as well as at upper portions in the upward inclined direction and the left-right direction, and the shutter 22 is configured so as to cover these portions.

However, there is no limitation to such an exemplary embodiment, and, for example, the collection space SC inside the frame 21 may be configured not to open up in the rear inclined direction, with the collection space SC only opening up at upper portions in the upward inclined direction and in the left-right direction. Namely, it is sufficient that the user is able to remove the banknotes BL inside the collection space SC, and that the banknotes BL inside the collection space SC are visible from the diagonal top left and right, these being the vantage points of the user, when the shutter 22 has transitioned to the open state. The same also applies to the second to fourth exemplary embodiments.

In the first exemplary embodiment described above, explanation has been given regarding a case in which the shutter 22 transitions to the closed state or the open state by turning the shutter 22 about the turn shaft 23.

However, there is no limitation to such an exemplary embodiment, and, for example, configuration may be made in which the shutter 22 transitions to the closed state or the open state by being displaced using various mechanisms or methods, for example by sliding with a sliding mechanism.

Figure 18:
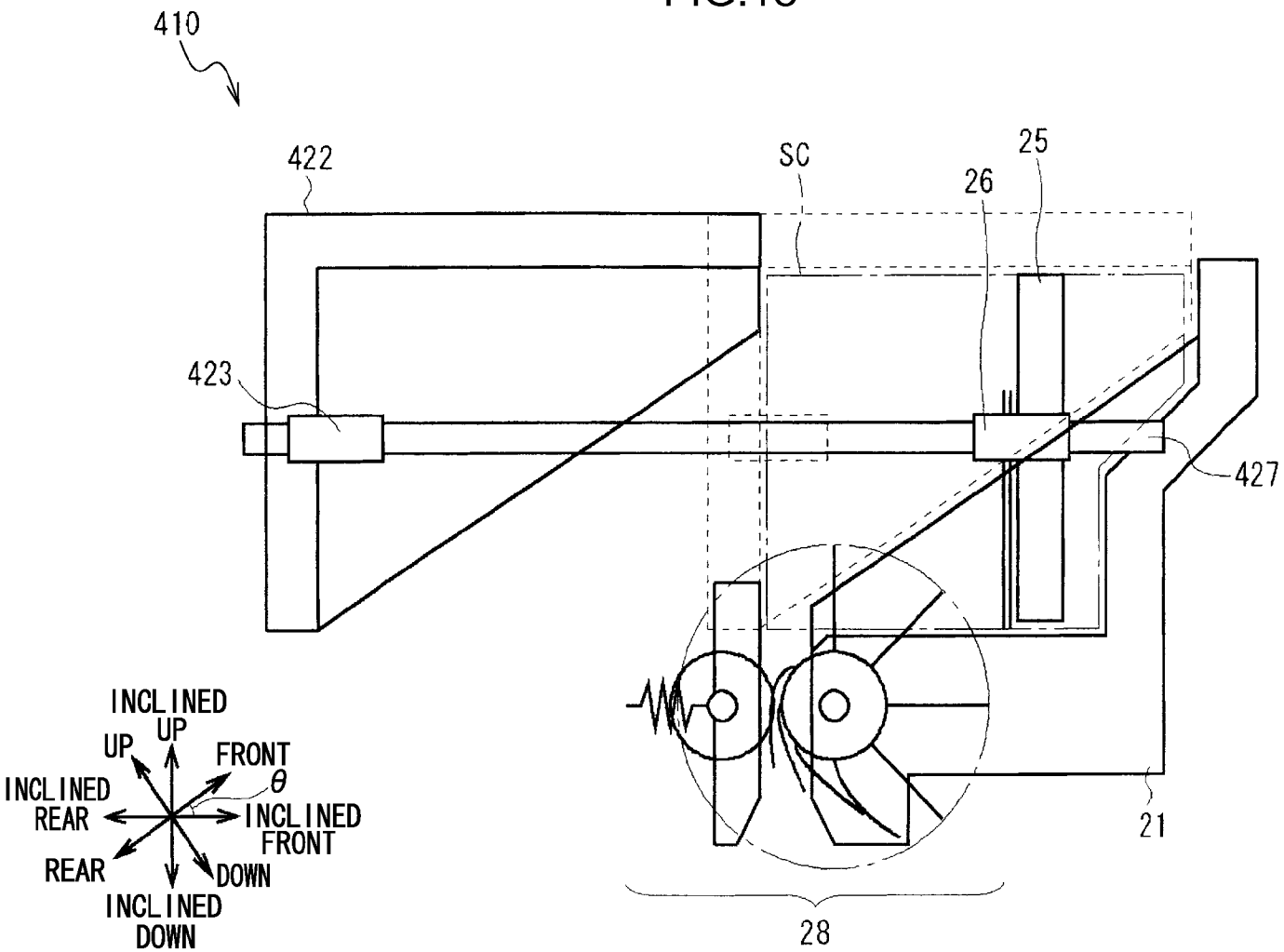
FIG. 18 is a schematic view illustrating a configuration of a banknote handover section according to another exemplary embodiment.

For example, as illustrated in FIG. 18 corresponding to FIG. 4A, in a banknote handover section 410, supports 423 configured similarly to the supports 26 are attached to a shutter 422 corresponding to the shutter 22, and sliding shafts 427, which are configured by extending the sliding shafts 27 toward the rear inclined direction, pass through the supports 423.

The banknote handover section 410 enables the shutter 422 to transition to the closed state or the open state by sliding the supports 423 along the sliding shafts 427 in the front-rear inclined direction.

In the first exemplary embodiment described above, explanation has been given regarding a case in which only the shutter 22, namely a single shutter, covers the upper portion of the frame 21. In the second exemplary embodiment, explanation has been given regarding a case in which two divided shutters such as the shutter 122 and the second shutter 141 cover the upper portion of the frame 121.

However, there is no limitation to such exemplary embodiments, and, for example, three or more divided shutters may cover the upper portion of the frame 21. In such a configuration, it is sufficient that the left side and the right side of the collection space SC can be opened up in addition to the inclined upper side by each of the divided shutters transitioning to an open state. The transition method of each shutter in such a configuration is not limited to turning, and may be configured by sliding, for example, as illustrated in FIG. 18, or may be an appropriate combination of these methods. The same also applies to the third and fourth exemplary embodiments.

Moreover, in the first exemplary embodiment described above, explanation has been given regarding a case in which the shutter 22 is biased toward the closing direction R2 by the spring 24 that is configured by a torsion spring disposed in the vicinity of the turn shaft 23.

However, there is no limitation to such an exemplary embodiment, and, for example, the shutter 22 may be biased toward the closing direction R2 by various resilient members such as a plate spring or a coil spring, in place of the spring 24. The same also applies to the second to fourth exemplary embodiments, and likewise, and the same applies to the springs 143, 243, and 343. In the first and second exemplary embodiments, the spring 24 may be omitted.

In the second exemplary embodiment described above, explanation has been given regarding a case in which the end portion 122AX of the upper portion 122A of the shutter 122 in the closed state faces the end portion 141X of the second shutter 141 in the second closed state, thereby restricting turning of the second shutter 141 in the opening direction S1.

However, there is no limitation to such an exemplary embodiment, and, for example configuration may be made in which both the end portion 122AX at the upper portion 122A of the shutter 122, and the end portion 141X of the second shutter 141 is formed in a flat plane shape along the up-down inclined direction, such that the second shutter 141 is able to turn freely even when the shutter 122 is in the closed state. The same also applies to the third and fourth exemplary embodiments.

In the third exemplary embodiment described above, explanation has been given regarding a case in which in the lock mechanism 250, the locking arm 251B of the locking lever 251 is positioned at and engages with the inclined rear side of the circular column shaped locking post 255 projecting from the shutter 222, so as to lock the shutter 222 in the closed state.

However, there is no limitation to such an exemplary embodiment, and the shutter 222 may be locked in the closed state using locking levers 251 of various shapes engaging with engagement sections of various shapes formed at the shutter 222.

In the third exemplary embodiment described above, explanation has been given regarding a case in which the link mechanism 260 is employed to transmit drive force to the both the locking lever 251 and the shutter 222 from a single actuator.

However, there is no limitation to such an exemplary embodiment, and, for example, the link mechanism 260 may be omitted, and drive force may be transmitted to the locking lever 251 and the shutter 222 from respective independent actuators. The same applies to the fourth exemplary embodiment.

In the third exemplary embodiment described above, explanation has been given regarding a case in which drive force is not transmitted from the link mechanism 260 to the second shutter 241, and the second shutter 241 is turned in the opening direction S1 by applying external force with the fingers of the user, for example.

However, there is no limitation to such an exemplary embodiment, and, for example an arm similar to the first arm 361A of the fourth exemplary embodiment may be added to the link lever 261, and the spring 243 replaced with the spring 343 for biasing in the opening direction S1, such that the second shutter 241 is opened and closed coupled with turning of the link lever 261.

In the third exemplary embodiment described above, explanation has been given regarding a case in which the side faces of the inclined upper side of the collection space SC are covered by the shutter 222 and the second shutter 241, and the shutter 222 is turned using the drive force of the link mechanism 260.

However, there is no limitation to such an exemplary embodiment, and, for example, similarly to the first exemplary embodiment, configuration may be made such that the side faces of the inclined upper side of the collection space SC are covered by the single shutter 22 (FIG. 4A and FIG. 4B), and the shutter 22 is turned using the drive force of the link mechanism 260.

In the third exemplary embodiment described above, explanation has been given regarding a case in which an optical sensor configures the shutter detection sensor 271 that detects whether or not the shutter 22 is in the closed state based on the position of the cam plate 265.

However, there is no limitation to such an exemplary embodiment, and, for example, the shutter detection sensor 271 may be configured by a mechanical switch, an electrical switch, or the like. The same applies to the link closed detection sensor 272 and the link open detection sensor 273, and the same also applies to the fourth exemplary embodiment.

In the fourth exemplary embodiment described above, explanation has been given regarding a case in which shutter opening processing (steps SP16 to SP18) according to the shutter closing processing routine RT2 (FIG. 13) is performed when the shutter has not closed, similarly to the third exemplary embodiment.

However, there is no limitation to such an exemplary embodiment, and, for example, processing to perform the shutter opening processing (steps SP16 to SP18) when the shutter has not closed may be omitted. Namely, since the lock mechanism 250 is not provided in the fourth exemplary embodiment, even if turning of the shutter 322 in the closing direction R2 is temporarily halted during closing processing due to a finger of the user or the like, once the finger or the like has been removed, the shutter 322 can transition to the closed state under the biasing force of the spring 24, without needing to reopen. The shutter detection sensor 371 may be omitted in such cases.

In the first exemplary embodiment described above, explanation has been given regarding a case in which the shutter 22 is configured from a resin material with high light transmissivity, such that the user is able to see the interior of the collection space SC in the closed state.

However, there is no limitation to such an exemplary embodiment, and the shutter 22 may be configured from various materials with low light transmissivity, such that the user is only able to see the interior of the collection space SC in the open state of the shutter 22. The same also applies to the second to fourth exemplary embodiments.

In the first exemplary embodiment described above, explanation has been given regarding a case in which the angle of inclination θ of the banknote handover section 10 with respect to the vertical direction and the horizontal direction is set at approximately 30°.

However, there is no limitation to such an exemplary embodiment, and, for example, the angle of inclination θ may be set at various angles, for example at 15° or 45°, or may be 0°, namely, such that there is no inclination. In the banknote handover section 10, the angle of inclination θ is preferably set in a range of between 0° and 45° in order to collect banknotes BL on the stage 25 such that the bottom edges of the banknotes BL abut the bottom face 21AX of the frame 21 in the collection space SC.

In the first exemplary embodiment described above, explanation has been given regarding a case in which the trapezoidal shaped cutaway portion is formed in the stage 25, in order to allow the banknotes BL to be gripped easily (FIG. 4B).

However, there is no limitation to such an exemplary embodiment, and, for example, similarly to the conventional banknote handover section 810, for example (FIG. 7A and FIG. 7B), an inclined upper portion of the stage 25 may be inclined toward the front in order to allow the banknotes BL to be gripped easily. The same also applies to the second to fourth exemplary embodiments.

In the first exemplary embodiment described above, explanation has been given regarding a case in which the present invention is applied to the banknote handover section 10 configuring the pay-out section 4 in which banknotes BL conveyed by the conveyance section 15 are internally collected, and removed by the user.

However, there is no limitation to such an exemplary embodiment, and, for example, the present invention may be applied to the pay-in section 3 into which the user inserts banknotes BL. In such a configuration, for example, a mechanism known as a separator, for separating and passing the banknotes BL held inside the collection space SC to the conveyance section 15 (FIG. 2) one note at a time, may be provided in place of the discharge section 28. The present invention may also be applied to a pay-in/pay-out section combining the functions of both the pay-in section 3 and the pay-out section 4. The same also applies to the second to fourth exemplary embodiments.

In the first exemplary embodiment described above, explanation has been given regarding a case in which the user removes the banknotes BL from the collection space SC in the banknote handover section 10 configuring the pay-out section 4 of the banknote processing device 1.

However, there is no limitation to such an exemplary embodiment, and the present invention may, for example, be applied to a medium handover section into which a user inserts a medium, or a user removes a medium, in a device handling various paper sheet shaped media encompassing various coupons, tickets, and the like. The same also applies to the second to fourth exemplary embodiments.

In the first exemplary embodiment described above, explanation has been given regarding a case in which the banknote handover section 10 serving as a medium handover device is configured by the frame 21 serving as a fixed peripheral side section, the shutter 22 serving as a lid section, the turn shaft 23 serving as a transition section, and the discharge section 28 serving as a transfer section.

However, there is no limitation to such an exemplary embodiment, and a medium handover device may be configured by fixed peripheral side sections, lid sections, transition sections, and transfer sections of various other configurations.

In the first exemplary embodiment described above, explanation has been given regarding a case in which the banknote processing device 1 serving as a medium processing device is configured by the frame 21 serving as a fixed peripheral side section, the shutter 22 serving as a lid section, the turn shaft 23 serving as a transition section, the conveyance section 15 serving as a conveyance section, and the discharge section 28 serving as a transfer section.

However, there is no limitation to such an exemplary embodiment, and a medium processing device may be configured by fixed peripheral side sections, lid sections, transition sections, conveyance sections, and transfer sections of various other configurations.

INDUSTRIAL APPLICABILITY

The present invention may be employed in various devices in which banknotes in a collected state are exchanged with a user.

The invention claimed is:

1. A medium handover device, comprising:

a fixed peripheral side section having a collection space formed therein, a paper sheet shaped medium being collected in the collection space and on a medium support section, a periphery of the collection space being defined by side faces including opposing front and rear side faces, and opposing left and right side faces that are adjacent to the front and rear side faces, the fixed peripheral side section covering a portion of the side faces of the collection space other than at least a further portion of the rear side face and further portions of the left and right side faces, which the further portions of the rear, left and right side faces are not covered by the fixed peripheral side section;

a lid section that has a shape covering the further portions of the rear side face, the left side face and the right side face that are not covered by the fixed peripheral side section;

a transition section that transitions the lid section to enable the lid section to adopt a closed state with respect to the fixed peripheral side section in which the lid section is close to or abutting the fixed peripheral side section so that the collection space, including the further portions of the rear, left and right side faces, is closed, and to adopt an open state with respect to the fixed peripheral side section in which at least a portion of the lid section is separated from the fixed peripheral side section, so that the collection space, including the further portions of the rear, left and right side faces, is opened; and a transfer section that transfers the medium between an interior and an exterior of the collection space.

2. The medium handover device of claim 1, wherein the transition section transitions the lid section to the closed state or the open state by turning the lid section with respect to the fixed peripheral side section.

3. The medium handover device of claim 2, further comprising:

a second lid section that closes the collection space by adopting a second closed state in which the second lid section closes the collection space while being adjacent to both the fixed peripheral side section and the lid section in the closed state, and enlarges the opening of the collection space by adopting a second open state in which at least a portion of the second lid section is separated from the collection space in the open state.

4. The medium handover device of claim 3, further comprising:

an opening and closing coupling section that transitions the second lid section between the second closed state and the second open state in conjunction with an operation of the transition section to transition the lid section between the closed state and the open state.

5. The medium handover device of claim 2, further comprising:

an engagement section that prevents the lid section from transitioning to the open state and retains the lid section in the closed state when engaged with the lid section in the closed state, and that permits transition of the lid section to the open state when engagement with the lid section has been released.

6. The medium handover device of claim 5, further comprising:

an engagement coupling section that effects or releases engagement of the lid section by the engagement section in conjunction with an operation of the transition section to transition the lid section between the closed state and the open state.

7. The medium handover device of claim 6, wherein the engagement coupling section begins transition of the lid section from the closed state to the open state after engagement between the lid section in the closed state and the engagement section has been released, and engages the engagement section with the lid section after transition of the lid section from the open state to the closed state has been completed.

8. The medium handover device of claim 2, further comprising:

a bias section that biases the lid section so as to turn in a direction of transition to the closed state; and an opening displacement section that displaces with respect to the fixed peripheral side section while in contact with the lid section, so as to turn the lid section against the bias of the bias section such that the lid section transitions from the closed state to the open state.

9. The medium handover device of claim 1, wherein the collection space is positioned in an intersecting direction that intersects with both a direction running from the medium support section to the opposing side face, and a collection direction of the medium.

10. The medium handover device of claim 1, further comprising:

a one-face support section that supports one face of the medium collected in the collection space, and that exposes, in the collection space, at least a portion of an opposite side edge of the medium that is opposite to a side edge supported by the medium support section.

11. A medium processing device, comprising:

the medium handover device of claim 1; and a conveyance section that conveys the medium, wherein the transfer section transfers the medium between the conveyance section and the collection space.

12. The medium processing device of claim 11, further comprising:

a controller that controls the transition section to transition the lid section to the open state or to the closed state; and a detection section that detects that the lid section is in the closed state and notifies the controller of a detection result, wherein the controller effects control such that, after controlling the transition section to transition the lid section from the open state to the closed state, the lid section is transitioned to the open state again, and then the lid section is transitioned to the closed state again, in a case in which the controller has received notification that the lid section is not in the closed state based on a detection result from the detection section.

13. A medium handover device comprising:

a fixed peripheral side section that covers portions of side faces enclosing a periphery of a collection space in which a paper sheet shaped medium is collected, other than at least a portion of an opposing side face opposing a medium support section supporting the medium inside the collection space, which portion is open, and other than at least a portion of an adjacent side face adjacent to the opposing side face, which portion is open;

a lid section that has a shape covering portions of the side faces enclosing the periphery of the collection space that are not covered by the fixed peripheral side section;

a transition section that transitions the lid section to enable the lid section to adopt a closed state with respect to the fixed peripheral side section in which the lid section is close to or abutting the fixed peripheral side section and the collection space is closed, and to adopt an open state with respect to the fixed peripheral side section in which at least a portion of the lid section is separated from the fixed peripheral side section and the collection space is opened;

a transfer section that transfers the medium between an interior and an exterior of the collection space; and an engagement section that prevents the lid section from transitioning to the open state and retains the lid section in the closed state when engaged with the lid section in the closed state, that permits transition of the lid section to the open state when engagement with the lid section has been released; and an engagement coupling section that effects or releases engagement of the lid section by the engagement section in conjunction with an operation of the transition section to transition the lid section between the closed state and the open state, wherein the transition section transitions the lid section to the closed state or the open state by turning the lid section with respect to the fixed peripheral side section.

14. A medium handover device comprising:

a fixed peripheral side section that covers portions of side faces enclosing a periphery of a collection space in which a paper sheet shaped medium is collected, other than at least a portion of an opposing side face opposing a medium support section supporting the medium inside the collection space, which portion is open, and other than at least a portion of an adjacent side face adjacent to the opposing side face, which portion is open;

a lid section that has a shape covering portions of the side faces enclosing the periphery of the collection space that are not covered by the fixed peripheral side section;

a transition section that transitions the lid section to enable the lid section to adopt a closed state with respect to the fixed peripheral side section in which the lid section is close to or abutting the fixed peripheral side section and the collection space is closed, and to adopt an open state with respect to the fixed peripheral side section in which at least a portion of the lid section is separated from the fixed peripheral side section and the collection space is opened;

a transfer section that transfers the medium between an interior and an exterior of the collection space;

a bias section that biases the lid section so as to turn in a direction of transition to the closed state; and an opening displacement section that displaces with respect to the fixed peripheral side section while in contact with the lid section, so as to turn the lid section against the bias of the bias section such that the lid section transitions from the closed state to the open state, wherein the transition section transitions the lid section to the closed state or the open state by turning the lid section with respect to the fixed peripheral side section.

* * * * *